US007331812B2

(12) United States Patent
Nishio et al.

(10) Patent No.: US 7,331,812 B2
(45) Date of Patent: Feb. 19, 2008

(54) CONNECTOR FOR CONNECTING ELECTRONIC COMPONENT

(75) Inventors: Atsushi Nishio, Tama (JP); Shinichi Asano, Tama (JP); Yoshihiro Ishikawa, Tama (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/605,393

(22) Filed: Nov. 29, 2006

(65) Prior Publication Data

US 2007/0123089 A1 May 31, 2007

(30) Foreign Application Priority Data

Nov. 30, 2005 (JP) ..... 2005-347124
Feb. 27, 2006 (JP) ..... 2006-051337
Jul. 31, 2006 (JP) ..... 2006-209181

(51) Int. Cl.
*H01R 4/50* (2006.01)

(52) U.S. Cl. ..... 439/342; 439/331

(58) Field of Classification Search ..... 439/331, 439/342, 607

See application file for complete search history.

(56) References Cited

U.S. PATENT DOCUMENTS 4,554,505 A * 11/1985 Zachry ..... 324/755
4,820,190 A * 4/1989 Humphrey ..... 439/395
5,293,177 A * 3/1994 Sakurai et al. ..... 343/906
5,530,291 A * 6/1996 Chan et al. ..... 257/723
5,690,505 A * 11/1997 Hirata ..... 439/402
2006/0270283 A1* 11/2006 Kumazawa et al. ..... 439/676
2007/0123089 A1* 5/2007 Nishio et al. ..... 439/342

FOREIGN PATENT DOCUMENTS

JP 2000-216412 8/2000
JP 2005-117604 4/2005

* cited by examiner

*Primary Examiner*—James R. Harvey
(74) *Attorney, Agent, or Firm*—The Nath Law Group; Jerald L. Meyer; Jonathan A. Kidney

(57) ABSTRACT

An electronic-component connector forms a secure detachable connection and is packaged in a small space even when the electronic component is a module that is linked to an optical waveguide, and transmits and receives a signal such as an optical signal via the transfer member. An optical waveguide extends from a first side of a module connected to the connector. The connector body of the electronic-component connector has an open portion for accommodating a module inserted from the open side. A socket contact portion for contacting a connection terminal of the module is provided to the open portion. A lead-out path is formed in the shape of a groove in the connector body communicated with the open portion, and leads out the optical waveguide from the connector body. A cover member is attached to the connector body so as to open, close, and secure the module inside the open portion.

15 Claims, 15 Drawing Sheets

CONNECTOR FOR CONNECTING ELECTRONIC COMPONENT

CROSS REFERENCE TO RELATED APPLICATIONS

The disclosure of Japanese Patent Application No. 2005-347124, filed on Nov. 30, 2005, Japanese Patent Application No. 2006-51337, filed on Feb. 27, 2006, and Japanese Patent Application No. 2006-209181, filed on Jul. 31, 2006 including the specification, drawings and abstract is incorporated herein by reference in its entirely.

BACKGROUND OF THE INVENTION

1. Field of the Invention

The present invention relates to an electronic-component connector that connects an electronic component such as a module joined to an optical waveguide.

2. Description of the Related Art

Conventionally, foldable mobile electronic equipments in mobile telephones, laptop personal computers, and the like have a structure in which an LCD (Liquid Crystal Display) is provided to a sub case mounted so as to be capable of folding with respect to a main case that has an apparatus controller.

In such a foldable electronic equipment, an FPC (Flexible Printed Circuit) is disposed at the connecting portion between the main case and the sub case, as described in Japanese Laid-open Patent Application No. 2005-117604, for example. This FPC forms a connection between electrical components (modules) such as semiconductor elements that are mounted on the substrates of each of the main case and the sub case, and display information for the LCD is transmitted by an electrical signal from the apparatus controller in the main case to the sub case.

In this type of electronic equipment, an LCD is desired that has an increased number of pixels and large size, and that can display a color image having increased fineness (higher resolution).

With the electronic equipment having the above-described FPC, the amount of information that must be transmitted by an FPC whose transmitting portion is made from copper increases according to the enlargement and increase in fineness of an LCD, and therefore there is a problem that a large amount of noise occurs during transmission, and crosstalk is produced.

In order to solve this problem, a method can be considered that uses an optical signal instead of an electrical signal to transmit the information that is to be displayed in the LCD.

When display information is transmitted optically in this manner, an optical waveguide for guiding light is needed in place of the FPC, and a module such as a photodiode for transmitting and receiving the light of the optical waveguide is also needed.

The module such as a photodiode is mounted by direct-mounting an electrode of the module (optical device) to the predetermined electrode on the substrate as in the optical device disclosed in Japanese Laid-open Patent Application No. 2000-216412, for example.

In the conventional foldable mobile electronic equipment, when an optical waveguide is used to transmit display information from the main case to the LCD of the sub case, the space in which the optical waveguide or the module such as a photodiode are mounted is preferably minimized in the structure of the mobile electronic equipment.

However, there is no conventional equipment which can achieve this aim and in which an optical waveguide and a module such as photodiode for processing the light of the optical waveguide for an LCD display are directly connected to each other, and there is no conventional connector that enables the module to be removed from the substrate of the sub case for maintenance.

SUMMARY OF THE INVENTION

It is therefore an object of the present invention to provide a secure detachable connection that is packaged in a small space even when an electronic component is a module or the like that is linked to a transfer member of a signal such as an optical waveguide, and that transmits and receives an optical signal or other type of signal via the transfer member.

Another object of the present invention is to provide an easily detached connection even when the size is reduced in accordance with reduced packaging space.

The above-described objects can be achieved with the present invention by providing an electronic-component connector that connects an electronic component connected in a state in which a signal transfer member extends from one side, the electronic-component connector having: a connector body that has an open portion that opens upward and in which the electronic component is inserted from an open side and accommodated, and a contact terminal that is provided inside the open portion and is used for contacting a connection terminal of the electronic component when the electronic component is inserted into the open portion; a lead-out portion that is formed continuously with the open portion in the connector body and is used for guiding the transfer member that extends from the electronic component accommodated in the open portion to an outside of the connector body; and a fixing portion that is attached to the connector body from the open side and is used for pushing the electronic component inserted into the open portion in an insertion direction and fixing the electronic component.

The above-described objects are also achieved by an electronic-component connector that connects an electronic component connected in a state in which a signal transfer member extends from one side, the electronic-component connector having: a connector body that has an open portion that opens upward and in which the electronic component is inserted from an open side and accommodated, and a contact terminal that is provided inside the open portion and is used for contacting a connection terminal of the electronic component when the electronic component is inserted into the open portion; a lead-out portion that is formed continuously with the open portion in the connector body and is used for guiding the transfer member that extends from the electronic component accommodated in the open portion to an outside of the connector body; a lid portion that is fitted to the connector body so as to be able to pivot open and closed, and is used for covering the open portion from an open side, pushing the electronic component inserted into the open portion in an insertion direction, and fixing the electronic component; and an ejecting portion that moves in conjunction with rotation of the lid portion in an opening direction away from the open portion and protrudes into the open portion, and that is used for pushing the electronic component inserted into the open portion out of the open portion and towards the opening.

DESCRIPTION OF THE PREFERRED EMBODIMENT

Embodiments of the present invention will be described in detail below with reference to the accompanying drawings.

Embodiment 1

Figure 1:
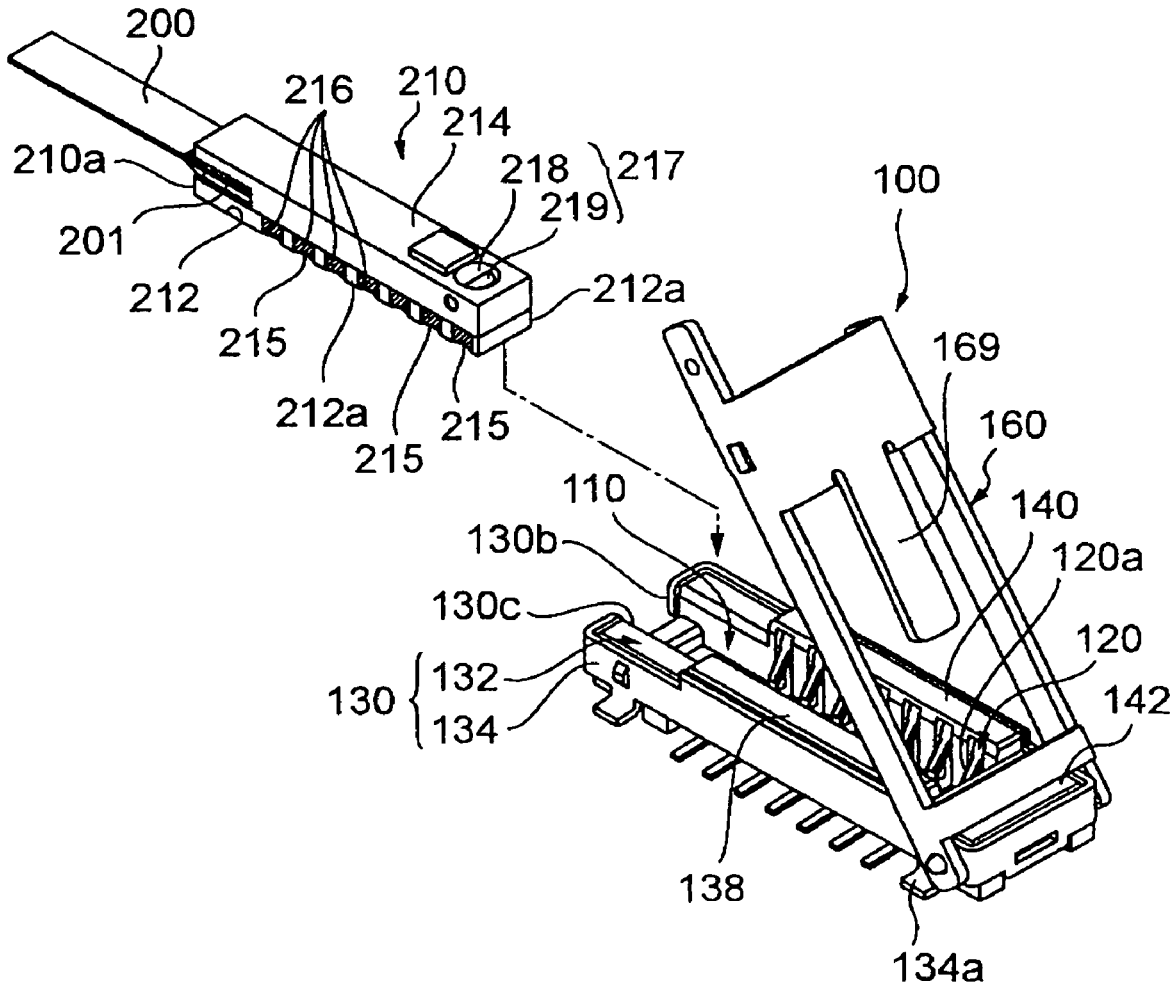
FIG. 1 shows the structure of the electronic-component connector according to Embodiment 1 of the present invention.

FIG. 1 shows the structure of the electronic-component connector according to Embodiment 1 of the present invention. A module to which an optical waveguide is attached will be used in the description as the electronic component that is connected to electronic-component connector 100. The surface of the electronic-component connector that is mounted on the substrate is the bottom surface in the present embodiment, and the direction in which the optical waveguide is attached to the module is the distal end direction.

Electronic-component connector 100 shown in FIG. 1 detachably connects module 210 for receiving the light of optical wave guide 200, converting the light to a voltage, and outputting the voltage, and optical waveguide 200 for guiding an optical signal is attached to module 210. Connected module 210 is shielded and protected from electric fields or magnetic fields from the outside.

Module 210 to which optical waveguide 200 is attached will first be described.

Module 210 is in a rectangular prism shape in this instance, and optical waveguide 200 is attached so as to extend in the longitudinal direction of module 210 from one end surface 210*a* thereof.

Specifically, module 210 is provided with: substrate 212 to which one end 201 of optical waveguide 200 is joined; an optical signal processing section (not shown) that is mounted on substrate 212 and used to process optical signals received through optical waveguide 200; and module case (exterior portion) 214 that covers the optical signal processing section (electronic component body). Optical waveguide 200 is flexible, and is shaped as a film by using a cladding to cover two cores in the case of bi-directional signal transfer, and a single core in the case of unidirectional signal transfer.

In the case where optical waveguide 200 is bi-directional, the optical signal processing section is configured with light-receiving elements and light-emitting elements that receive and emit light through waveguides, and optical processing components such as capacitors and amplifiers that process and amplify the signals from these elements. In the case where the optical waveguide is unidirectional, the optical signal processing section is configured with light-emitting elements and light-receiving elements such as photodiodes, and optical processing components such as capacitors and amplifiers. In this arrangement, the optical signal processing section has an optical conversion function for outputting optical signals as voltages (electrical signals) when optical signals are inputted to the module. However, the optical signal processing section is not limited to this, and may also have an optical conversion function for outputting electrical signals as optical signals when electrical signals are inputted to the module.

Substrate 212 of module 210 is provided with connection terminals (electrodes) 215 adjacent to the mounting surface (not shown). With these terminals, a voltage (electrical signal) converted by the optical signal processing section are outputted to two lateral surfaces 212*a* that extend in the extension direction of optical waveguide 200. Connection terminals 215 are provided so as to be exposed on two lateral surfaces 212*a*, and when the mounting surface of substrate 212 is the back surface in this arrangement. Connection terminals 215 are disposed in concave portions 216 that are formed in two lateral surfaces 212*a* so as to open to the front and the sides of module 210. Concave portions 216 are formed toward the front surface of module 210 and are oriented downward and orthogonal to the surface portion of optical waveguide 200 in FIG. 1. When electrical contact is made with electronic-component connector 100, a connection is formed by insertion from the front side.

Module case 214 is formed using a conducting member that is electrically conductive, and is formed in this case by machining a metal sheet into a box shape that opens downward. Module case 214 forms a covering above the optical signal processing section into which optical waveguide 200 extends from one side, and absorbs noise that occurs during operation of the optical signal processing section.

Module case 214 is provided with detachment section 217 for detaching module 210 after module 210 has been connected to electronic-component connector 100. Indentation 218 is formed in the reverse side of module case 214, and shaft 219 is disposed across the inside of this indentation 218 to form this detachment section 217.

Module 210 thus configured is fitted into open portion 110 of electronic-component connector 100 that opens upward, and thereby electrodes 215 are connected to socket contacts 120 of electronic-component connector 100.

Figure 2:
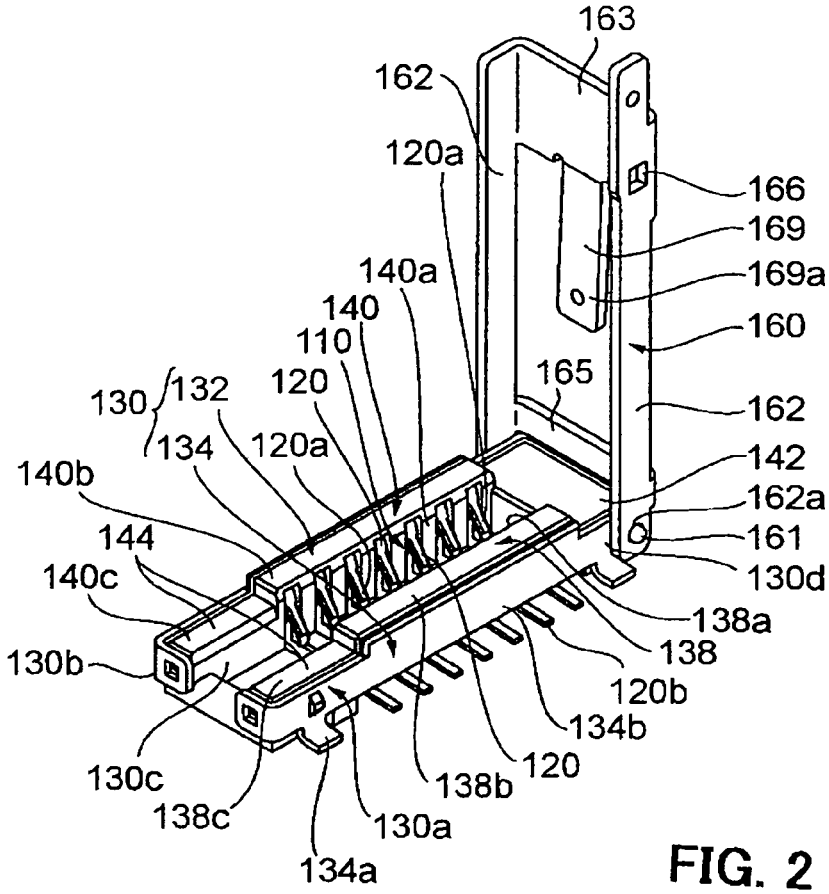
FIG. 2 shows the same electronic-component connector as viewed from above.
Figure 3:
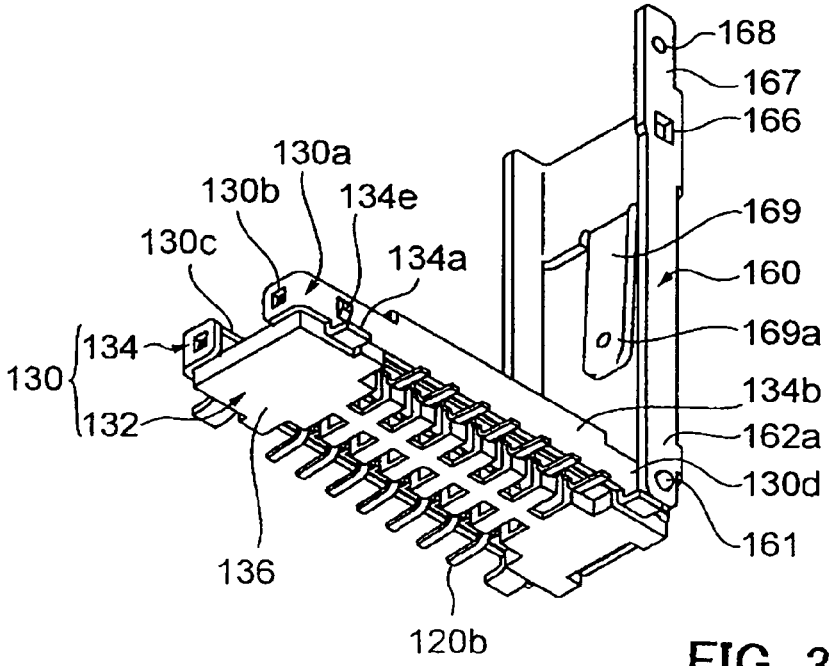
FIG. 3 shows the same electronic-component connector as viewed from a bottom.
Figure 4:
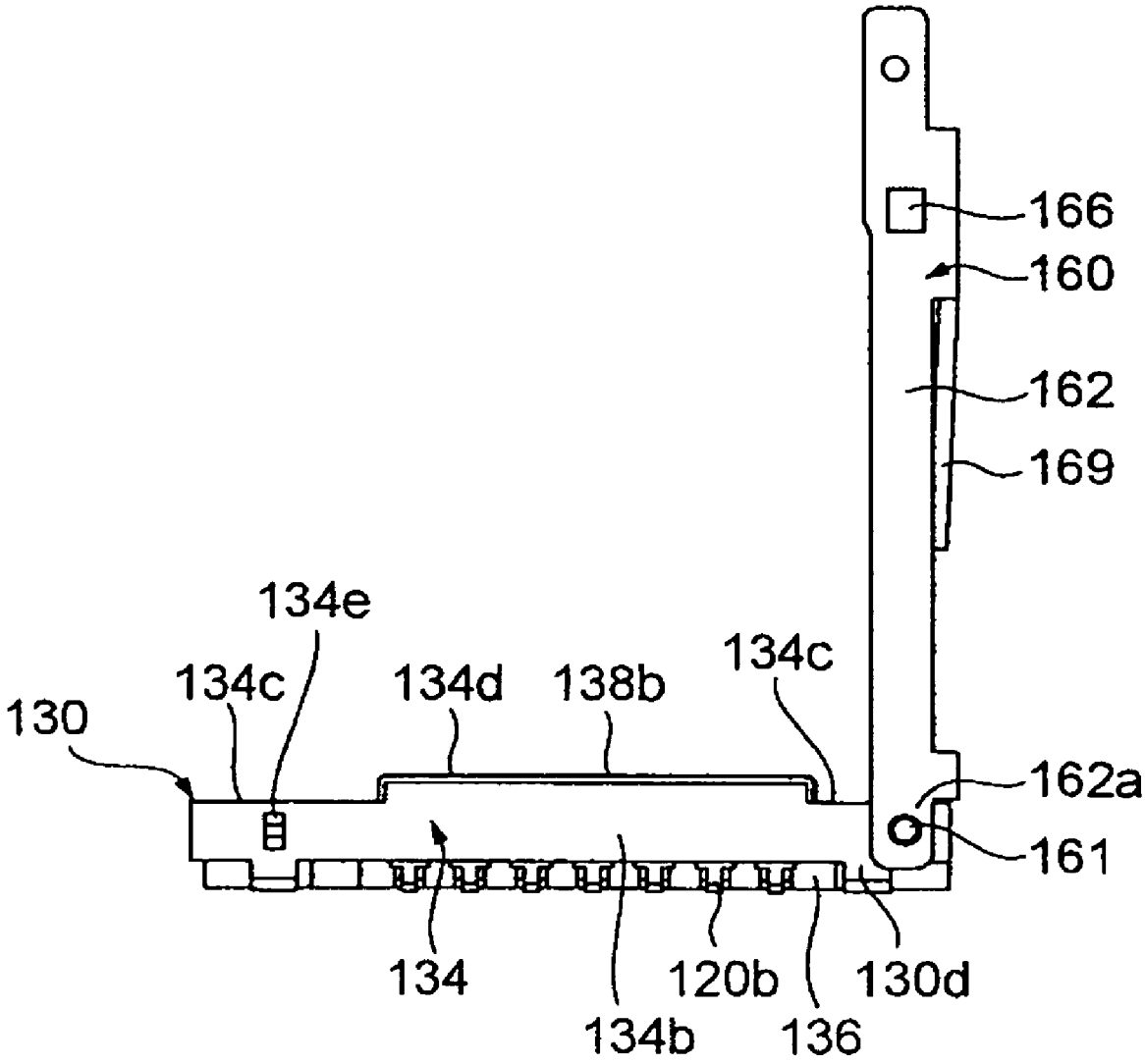
FIG. 4 shows the same electronic-component connector as viewed from a side.

FIG. 2 shows electronic-component connector 100 as viewed from above, FIG. 3 shows electronic-component connector 100 as viewed from a bottom, and FIG. 4 shows electronic-component connector 100 as viewed from a side.

As shown in FIGS. 2 through 4, electronic-component connector 100 has connector body 130 that has open portion 110 fitted by module 210 (see FIG. 1) being inserted into, and cover member 160 as a fixing portion for fixing module 210 (see FIG. 1) fitted by being inserted into open portion 110 of connector body 130, to connector body 130.

Connector body 130 has housing (housing portion) 132 that has open portion 110, and shield case (shield portion) 134 disposed on the periphery of housing 132 and used for shielding module 210 (see FIG. 1) that is fitted into open portion 110.

In housing 132, a pair of side wall portions 138 and 140 that face each other across a predetermined gap and extend in the longitudinal direction are provided on the top surface of rectangular plate-shaped bottom surface portion 136 that faces the mounting substrate, and proximal-end side wall portion 142 that is joined to the proximal end surfaces of both side wall portions 138 and 140 is provided at one end (proximal end in this case) of the pair of side wall portions 138 and 140. Housing 132 is made from an insulation member that has insulating properties and is made herein from synthetic resin such as insulating plastic.

Open portion 110 that is structured so as to open upward is formed with bottom surface portion 136 and the pair of side wall portions 138 and 140 in housing 132.

In housing 132, socket contacts (contact terminals) 120 for contacting connection terminals 215 (see FIG. 1) of module 210 when module 210 (see FIG. 1) is fitted into open portion 110 are provided to each of opposing faces 138*a* and 140*a* of two side wall portions 138 and 140, that is, each of the inner wall surfaces that face open portion 110.

Figure 5:
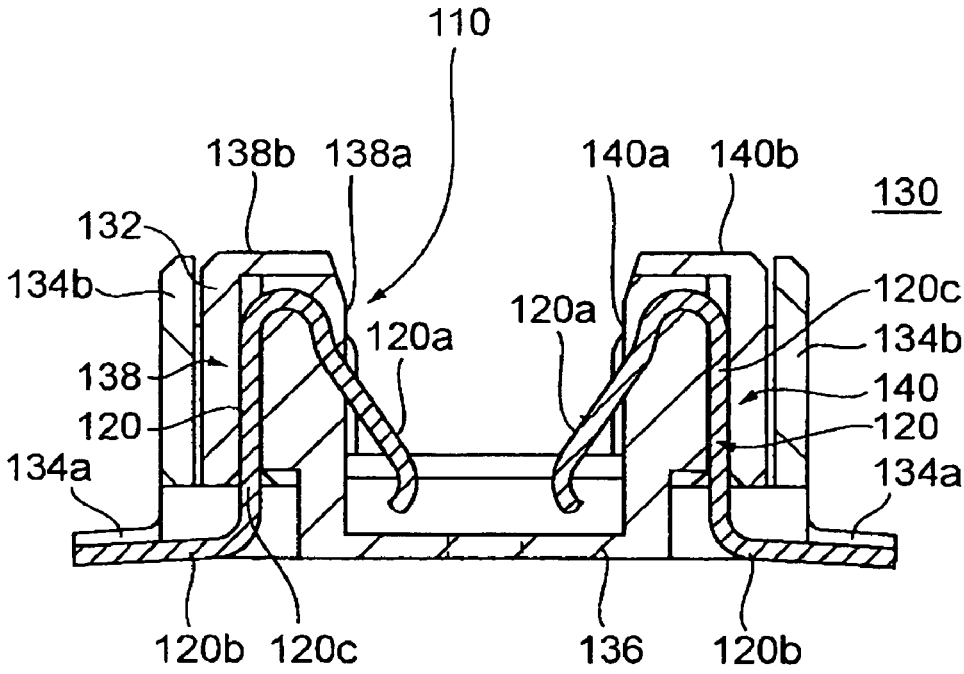
FIG. 5 is a sectional view showing the socket contacts provided to the housing in the connector body of the same electronic-component connector.

FIG. 5 is a sectional view showing socket contacts 120 provided to housing 132 in connector body 130 of electronic-component connector 100 according to Embodiment 1 of the present invention.

As shown in FIG. 5, socket contacts 120 in connector body 130 are made up of elongated plate-shaped members that are electrically conductive. One ends of socket contacts 120 are contact portions 120*a* that protrude from the opposing inner wall faces (opposing faces 138*a* and 140*a*) of open portion 110, and the other ends of socket contacts 120 are contact leads 120*b* that extend substantially parallel to the bottom surface of connector body 130—bottom surface portion 136—from contact portions 120*a* to the outside of connector body 130 via a plurality of holes formed in the lower surface of side wall portions 138 and 140 of housing 132. Center portions 120*c* are embedded in side wall portions 138 and 140, and thereby socket contacts 120 are attached to side wall portions 138 and 140.

Contact portions 120*a* of socket contacts 120 are guided into concave portions 216 (see FIG. 1) of substrate 212 in module 210 and are brought into contact with connection terminals 215 (see FIG. 1) of module 210 when module 210 is inserted from above into open portion 110 of electronic-component connector 100. Contact leads 120*b* are connected on the substrate when placed on the substrate on which electronic-component connector 100 is mounted.

Upper portions 138*b* and 140*b* in the position in which socket contacts 120 are provided as shown in FIGS. 1 through 4 have the highest elevation in the upper surfaces of side wall portions 138 and 140 of housing 132, and recessed portions 144 are formed in the other upper portions (upper portions on the distal end) 138*c* and 140*c*. The upper surface of proximal-end side wall portion 142 is at substantially the same height level so as to be in substantially the same plane as upper surface portions 138*c* and 140*c* at the distal ends of side wall portions 138 and 140. With proximal-end side wall portion 142, the proximal end side of connector body 130 is provided with a recessed shape in the same manner as recessed portions 144 formed on the distal end.

Socket contacts 120 are not provided to proximal-end side wall portion 142 or side wall portions 138 and 140 having recessions 144 in housing 132. Therefore, there is no need to ensure the height level or the strength needed when socket contacts 120 are provided to housing 132, so that the height level can be lowered correspondingly.

In housing 132, the height level of the upper surfaces of the two end portions in the longitudinal direction on both sides of the area which is formed by recessed portions 144 and proximal-end side wall portion 142 and in which socket contacts 120 of side wall portions 138 and 140 are provided is lower than the upper surface in the area in which socket contacts 120 are provided.

The height level of the other upper surface portion in which recessed portions 144 are formed is at substantially the same height level as the plane of the upper surface (back surface) of module 210 (see FIG. 1) when module 210 (see FIG. 1) is inserted and positioned in open portion 110. In other words, module 210 fitted into open portion 110 is lower than the height at which socket contacts 120 are provided in side wall portions 138 and 140.

As shown in FIGS. 2 and 3, lead-out path 130*c* that extends in the longitudinal direction from one end surface (distal end surface) 130*b* of connector body 130 is formed to guide optical waveguide 200 (see FIG. 1) of fitted module 210 (see FIG. 1) at one of the ends (distal end) that are separated in the longitudinal direction of connector body 130, that is, between side wall portions 138 and 140 at one end. In this configuration, when module 210 (see FIG. 1) is fitted into open portion 110, optical waveguide 200 attached to module 210 (see FIG. 1) is not retained by electronic-component connector 100, and is guided to the outside of electronic-component connector 100.

Shield case 134 (see FIG. 1) is shaped as a rectangular frame and is provided to the external peripheral portion, except the lead-out path of housing 132 that forms lead-out path 130*c*. Specifically, shield case 134 is provided so as to surround housing 132 from the sides and to shield module 210 accommodated in open portion 110 of shield case 134.

Shield case 134 extends parallel to bottom surface portion 136 of connector body 130 from the lower edge of shield case 134, and is provided with leads (fixed terminal portions) that are attached to the mounting substrate.

Shield case 134 is formed using a conducting member that is electrically conductive, is formed in this case by machining a metal sheet, and is fixed to the substrate by fixing leads 134*a* to the substrate.

Leads 134*a* are formed continuously with side wall cover portion 134*b* that covers the external surface of the left and right sides in housing 132, and are formed so as to extend from the lower edges of side wall cover portion 134*b*.

Leads 134*a* are fixed electrically connected to the ground portion of the substrate on which electronic-component connector 100 is mounted. In other words, Leads 134*a* are fixed in a state of electrical connection to the GND land portion of the substrate by soldering or the like.

Shield case 134 formed using a conducting member is thereby electrically connected to the GND land of the substrate via leads 134*a* when electronic-component connector 100 is mounted on the substrate. In other words, when electronic-component connector 100 is mounted on the substrate, shield case 134 is fixed to the substrate while kept conductive relative to the GND of the substrate.

As shown in FIG. 4, shield case 134 has a shape that corresponds to the shape of the external peripheral surface of housing 132 that is disposed inside shield case 134, and in the height level of the upper edge of side wall cover portion 134*b* that covers the outside of the side surface portion of side wall portions 138 and 140 and proximal-end side wall portion 142 of housing 132, the upper portion of contact leads 120*b* is the highest. In other words, in side wall cover portion 134*b*, the height level of upper edges 134*c* at the longitudinally separated distal end and proximal end, in which the area below the edges is devoid of contact leads 120*b*, is lower than that of upper edge 134*d* in which area below the edge is devoid of contact leads 120*b*.

Module 210 (see FIG. 1) fitted into open portion 110 of connector body 130 thus configured is covered by cover member 160 from the opening direction of open portion 110, that is, from above connector body 130. Module 210 is thereby fixed in a state of electrical connection to connector body 130.

Cover member 160 has a pair of arm portions 162 in which one end 162*a* is attached so as to be able to rotate about shaft portion 161 that is oriented perpendicular to the longitudinal direction on the two side portions of proximal end 130*d* of connector body 130, installation plate portion 163 that is disposed on recessed portions 144 at the distal end of the connector body and installed between the pair of arm portions 162, and reinforcing installation plate portion 165 that is disposed on proximal-end side wall portion 142 of connector body 130.

Cover member 160 is made up of a conducting member that is electrically conductive, and the pair of arm portions 162 are continuous with installation plate portion 163, reinforcing installation plate portion 165, and pushing member (presser plate, fixing portion) 169 provided to installation plate portion 163. In this arrangement, cover member 160 is formed by machining a metal sheet, and two arm portions 162 are provided so as to be continuous with the upper surface portion that has installation plate portion 163, reinforcing installation plate portion 165, and pushing member 169 provided to installation plate portion 163.

Arm portions 162 are shaped as plates, and rotating the arm portions about end portions 162*a* brings the arm portions to positions covering the side surfaces of connector body 130—the outer surfaces of side wall cover portions 134*b*—, when installation plate portion 163 is disposed in recessions 144.

One of arm portions 162 is provided with latch hole 166 that engages with interlocking part 134*e* formed in one of side wall cover portions 134*b* and fixes cover member 160 to connector body 130 when cover member 160 is closed to a position covering the outer surfaces of side wall cover portions 134*b*. Interlocking part 134*e* and latch hole 166 are configured with protuberance 134*e* that protrudes from the outer surface of the distal end portion of side wall cover portion 134*b*, and engaging hole 166 that is formed in arm portions 162 and used to accept and engage protuberance 134*e*. The configurations of the locking portion and the locked portion are not limited, and any configuration may be adopted providing that cover member 160 can be closed and module 210 (see FIG. 1) in housing 132 that is fitted into open portion 110 can be fixed to connector body 130 by installation plate portion 163. For example, a configuration maybe adopted in which a protrusion is provided to the cover member, and a latch hole is provided to the side-wall covering of housing 132.

In electronic-component connector 100 herein, locked portion 166 of arm portions 162 and side wall cover portion 134*b* of shield case 134 are joined together, and thereby arm portions 162 and shield case 134 are connected and made continuous with each other. A configuration may also be adopted in which conduction between arm portions 162 and shield case 134 is accomplished by contact rather than by joining portions of arm portions 162 and shield case 134 together when cover member 160 is closed with respect to connector body 130. For example, the inner surfaces of arm portions 162 may be in contact with the outer surface of shield case 134 when cover member 160 is closed with respect to connector body 130.

Operation member 167 (see FIG. 3) for facilitating the opening and closing of cover member 160 is provided to arm portion 162. Operation member 167 is formed by lever 167 created by extending the distal end of one of the arm portions in the axial direction of the arm portions. Through-hole 168 that runs parallel to axis portion 161 of cover member 160 is formed in lever 167, and cover member 160 can be opened and closed with respect to connector body 130 by inserting a fixture into through-hole 168 and rotating cover member 160.

When installation plate portion 163 is placed in recessions 144 (see FIG. 4), module 210 (see FIG. 1) is fitted into open portion 110, and an electrical connection is established with connector body 130, module 210 (see FIG. 1) is prevented from moving towards the front surface, that is, upward from connector body 130.

Installation plate portion 163 is also provided with pushing member 169 for pushing module 210 (see FIG. 1) fitted into open portion 110 downward (towards the socket contacts) from the upper surface (back surface).

Pushing member 169 has a flexible plate shape such as a leaf spring and extends downward at an incline from the edge of the proximal end of installation plate portion 163 towards the proximal end of cover member 160. Free-end portion 169*a* thereof is disposed so as to be positioned substantially in the middle of the module fitted into open portion 110.

Hemispherical contacting convex portion 169*b* (see FIG. 11) that protrudes downward is formed on the lower surface of free-end portion 169*a*. Contacting convex portion 169*b* makes contact with the upper surface of module 210 inserted into open portion 110, and presses against module 210. Contacting convex portion 169*b* is formed by downward embossing of part of free-end portion 169*a* of pushing member 169 made up of an elongated metal sheet.

Cover member 160 was described herein as being made up of a conducting member that is electrically conductive, but this configuration is not limiting, and cover member 160 may also be made from a resin that includes a synthetic resin such as plastic. In this case, the pair of arm portions 162, installation plate portion 163, reinforcing installation plate portion 165, and pushing member 169 provided to installation plate portion 163 in cover member 160 are each made from a resin. According to this configuration, it is possible to form cover member 160 having a complex structure that includes components such as the pair of arm portions 162, installation plate portion 163, reinforcing installation plate portion 165, installation plate portion 163 and pushing member 169, from a resin by integral molding or the like, so that manufacturing cost can be reduced.

The method for connecting the electronic-component connector with a module that has an optical waveguide will next be described.

As shown in FIG. 1, cover member 160 of electronic-component connector 100 is opened, and module 210 to which optical waveguide 200 is connected is inserted from the front side—the substrate side—of module 210 from above connector body 130 into upwardly exposed groove-shaped open portion 110 of connector body 130.

Contact portions 120*a* of socket contacts 120 of connector body 130 are then guided into concave portions 216 that are formed in the surfaces of both sides of substrate 212 so as to open downward and to both sides in module 210, connection terminals 215 of substrate 212 come into contact with corresponding contact portions 120*a*, and module 210 is fitted into open portion 110.

Figure 6:
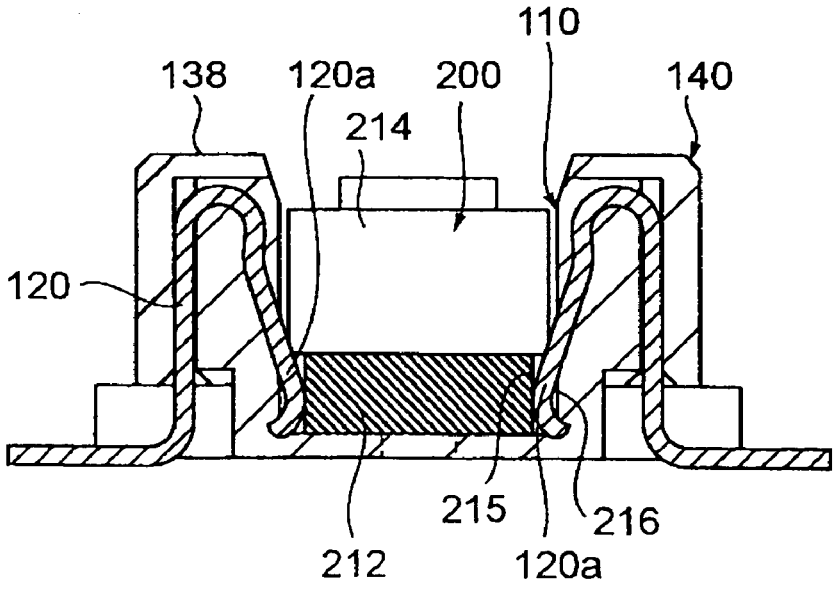
FIG. 6 is a sectional view showing a state in which a module is fitted into the housing of the same electronic-component connector.

FIG. 6 is a sectional view showing a state in which module 210 is fitted into housing 132.

At this time, contact portions 120*a* protrude towards the inside from side wall portions 138 and 140 of groove-shaped open portion 110 as shown in FIG. 6. Therefore, when contact portions 120*a* are guided to the inner surface portions of both side walls that open downward (insertion direction) in concave portions 216, contact portions 120*a* make contact in a state of elastic deformation at the proximal end, and are urged against connection terminals 215. A state of reliable contact between connection terminals 215 of the module and contact portions 120*a* of socket contacts 120 is thereby created.

After the module is fitted into open portion 110 of connector body 130, cover member 160 is closed, installation plate portion 163 is placed on recessed portions 144, and protrusion 134*e* of shield case 134 is engaged with latch hole 166 of cover member 160, and thereby installation plate portion 163 is fixed to connector body 130.

Figure 7:
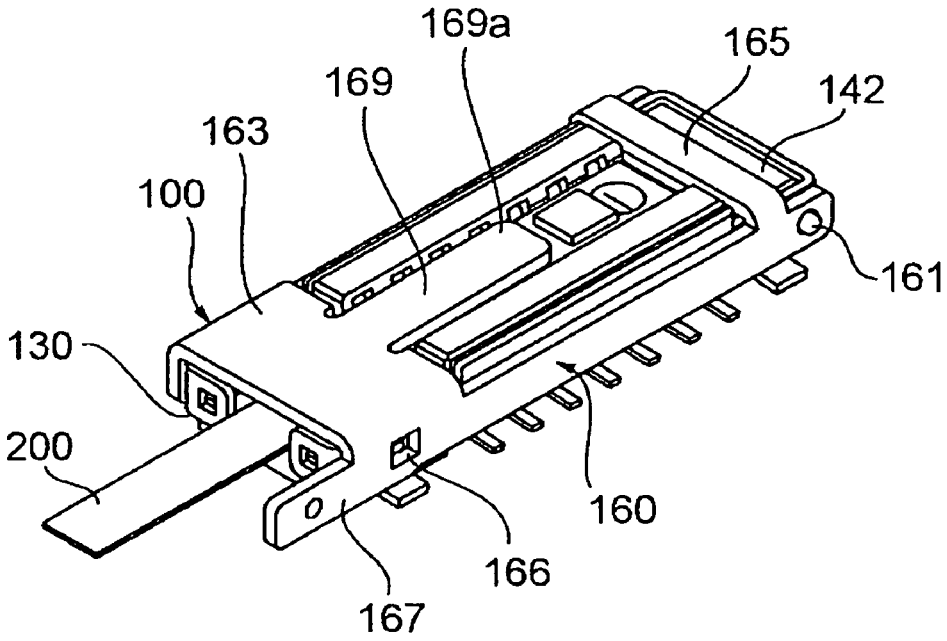
FIG. 7 shows a state in which a module is fitted into the electronic-component connector according to Embodiment 1 of the present invention.
Figure 8:
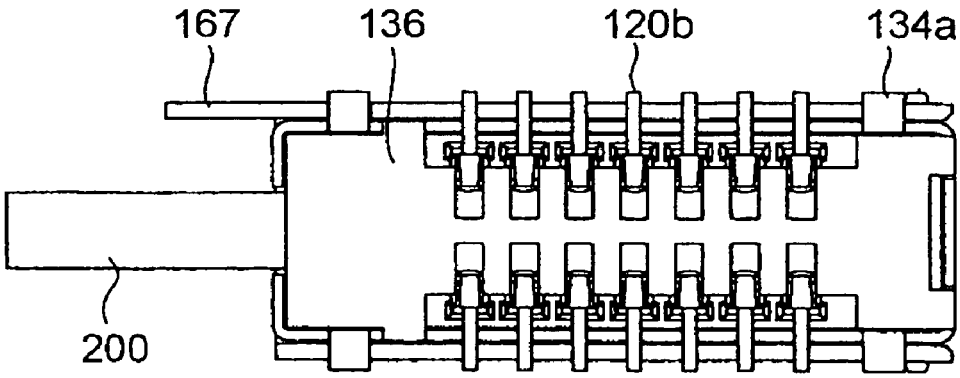
FIG. 8 shows a state in which a module is fitted into the electronic-component connector according to Embodiment 1 of the present invention.
Figure 9:
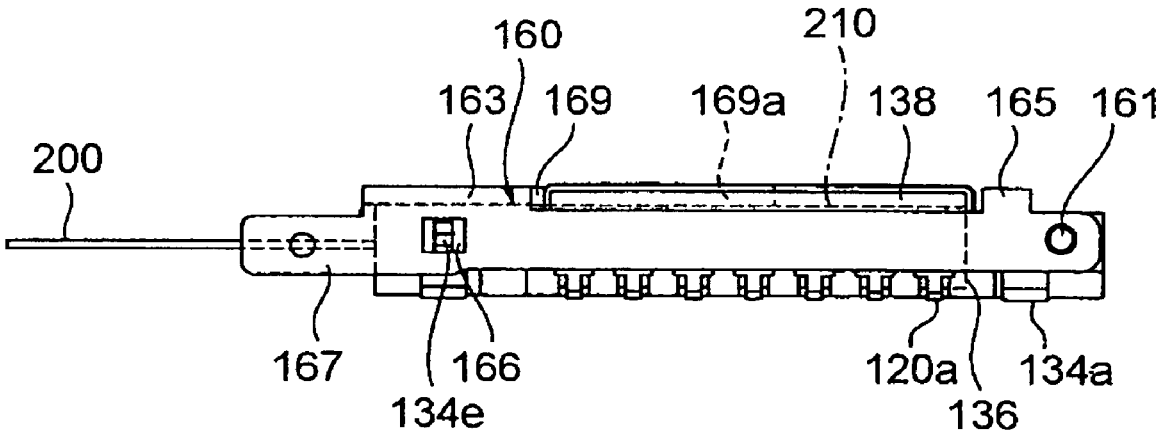
FIG. 9 shows a state in which a module is fitted into the electronic-component connector according to Embodiment 1 of the present invention.

FIGS. 7 through 9 show a state in which module 210 is fitted into electronic-component connector 100 according to Embodiment 1 of the present invention. FIG. 7 is a top perspective view of electronic-component connector 100, FIG. 8 is bottom surface view of electronic-component connector 100, and FIG. 9 is a side view of electronic-component connector 100.

As shown in FIGS. 7 through 9, module 210 fitted into connector body 130 is covered by cover member 160, and thereby module 210 is accommodated in electronic-component connector 100. Therefore, installation plate portion 163 is disposed on the back surface at the distal end of module 210, and free-end portion 169*a* of pushing member 169 that extends toward the proximal end (toward the proximal end of arm portions 162) from installation plate portion 163 presses on the substantial center of the back surface of module 210.

Installation plate portion 163 is thus positioned over the distal end of module 210, thereby preventing movement away from open portion 110 of module 210, that is, away from connector body 130.

Since pushing member 169 extends towards the proximal end of cover member 160 from installation plate portion 163 while tilting downward, module 210 is pressed from the substantial center portion of the back surface thereof when module 210 is fitted into open portion 110, and cover member 160 is closed, (see FIG. 9) This pressing force is transmitted to the entire area of contact (see FIG. 6) between socket contacts 120 and connection terminals 215 of module 210.

Accordingly, module 210 is reliably fixed in a state of electrical connection to connector body 130 in the contact portion by installation plate portion 163 and pushing member 169 without module 210 touching optical waveguide 200, or optical waveguide 200 being retained. Shock such as vibration imparted to the mounting substrate on which electronic-component connector 100 is mounted are therefore prevented from causing misalignment, disconnection, or fretting at the position of contact with module 210. Specifically, in the structure in which electronic-component connector 100 of the present embodiment is connected with module 210 provided with an optical waveguide, an electrical signal can be transmitted smoothly without module 210 becoming misaligned with respect to electronic-component connector 100.

In electronic-component connector 100, a recess is formed in the upper portion of connector body 130, excluding the area in which socket contacts 120 are provided, and installation plate portion 163 and reinforcing installation plate portion 165 that configure the upper surface of cover member 160 are positioned in the recessed portion. Therefore, the height of the upper surface of cover member 160 that is formed by installation plate portion 163 and by reinforcing installation plate portion 165, which are disposed on recessed portions 144 and proximal-end side wall portion 142, respectively, can be made equal to the height of socket contacts 120 (that is, the height of the position in which socket contacts 120 are provided in side wall portions 138 and 140). The height of electronic-component connector 100 as a whole can thereby be minimized, and a lower profile can be obtained.

Module 210 fitted into connector body 130 is thus covered by cover member 160, and thereby module 210 is accommodated in electronic-component connector 100, and a structure in which module 210 and electronic-component connector 100 are connected to each other is thereby formed.

Module 210 that is accommodated in housing 132 of electronic-component connector 100 and is fixed by cover member 160 to allow operation will be described herein. In other words, module 210 that is mounted in electronic-component connector 100 will be described.

Figure 10:
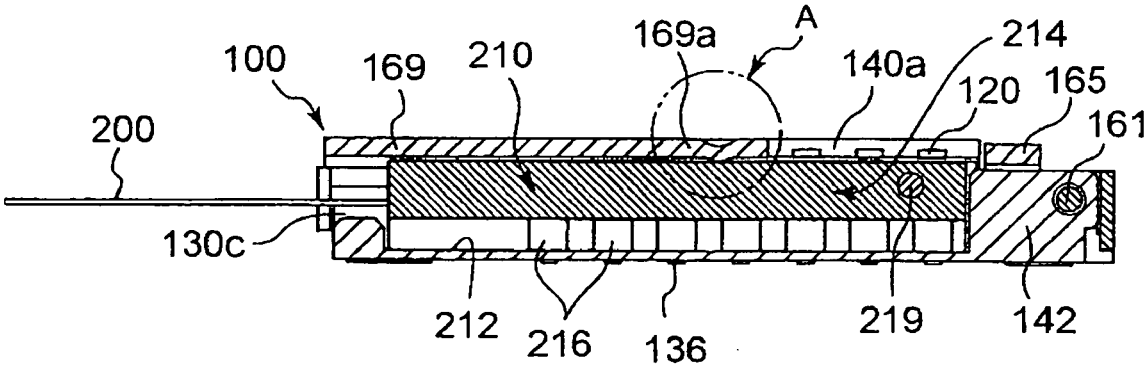
FIG. 10 shows a state in which a module is fitted into the electronic-component connector according to Embodiment 1 of the present invention.
Figure 11:
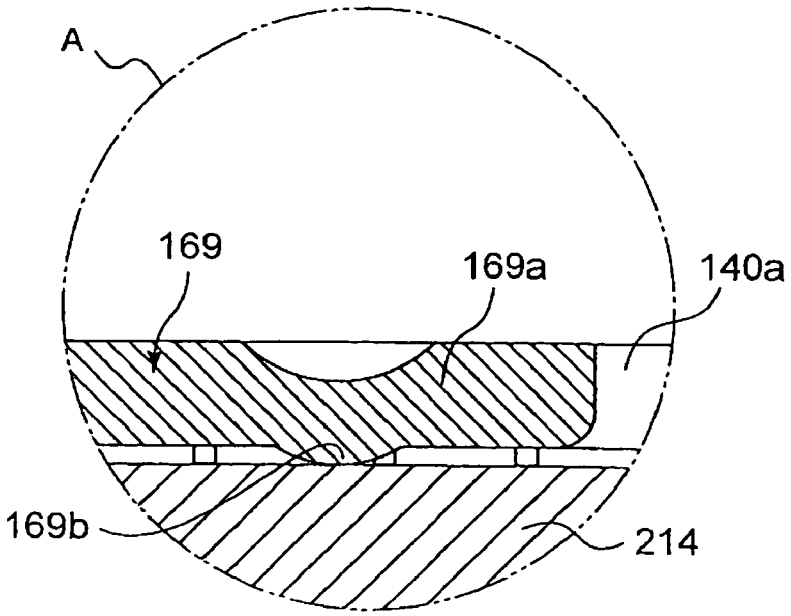
FIG. 11 is an enlarged sectional view of area A shown in FIG. 10.

FIG. 10 is a partial sectional view showing a state in which a module is fitted into the electronic-component connector according to Embodiment 1 of the present invention, and FIG. 11 is an enlarged sectional view of area A shown in FIG. 10.

As shown in FIGS. 10 and 11, module 210 is fixed in electronic-component connector 100 in a state in which the upper surface of module case 214 is in contact with contacting convex portion 169*b* of free-end portion 169*a* of pushing member 169 configuring the upper surface portion of cover member 160.

At this time, latch hole 166 provided to arm portion 162 in cover member 160 is engaged with protrusion 134*e* of shield case 134 as shown in FIG. 9. In other words, shield case 134 and cover member 160 made up of an electrically conductive member are brought into contact with each other by the engaging of latch hole 166 and protrusion 134*e*, and are in a state of electrical connection.

Specifically, in the state in which module 210 is mounted in electronic-component connector 100, cover member 160 made up of an electrically conductive member makes contact with module case 214 of module 210 via contacting convex portion 169*b* of pushing member 169 (see FIGS. 10 and 11). Cover member 160 is thereby made conductive with respect to module case 214.

In cover member 160, latch hole 166 formed in arm portion 162 contiguous with pushing member 169 engages with protrusion 134*e* of shield case 134 formed by an electrically conductive member, as shown in FIG. 9. Cover member 160 and shield case 134 are therefore electrically connected.

In other words, latch hole 166 engages with protrusion 134*e*, and thereby module 210 is electrically connected and made conductive relative to leads 134*a* of shield case 134 via protrusion 134*e*, latch hole 166 and pushing member 169 of cover member 160 in contact with module case 214. Module case 214 of module 210 is thereby made conductive relative to the ground portion of the substrate when the connector body is mounted on the substrate.

Accordingly, during operation of module 210 connected to module connector 100, any noise generated by this operation is absorbed by module case 214 and transmitted to the ground portion of the substrate via cover member 160 and shield case 134. Noise leakage during operation of module 210 can thereby be prevented. At this time, there is no need to provide separate noise-prevention wiring or the like to prevent noise leakage during operation of module 210, and noise leakage can be prevented merely by mounting the connector body on the substrate by fixing leads 134*a* of shield case 134 in a state of connection to the ground portion.

When module 210 is detached from electronic-component connector 100 to which module 210 is electrically connected, protrusion 134*e* is disengaged from latch hole 166, lever 167 is moved upward, and cover member 160 is opened. Module 210 is then separated from electronic-component connector 100 via detachment member 217 formed in module case 214. An example is described herein of the method of detachment when detachment member 217 in module 210 is formed by hollow portion 218 and shaft 219.

Figure 12:
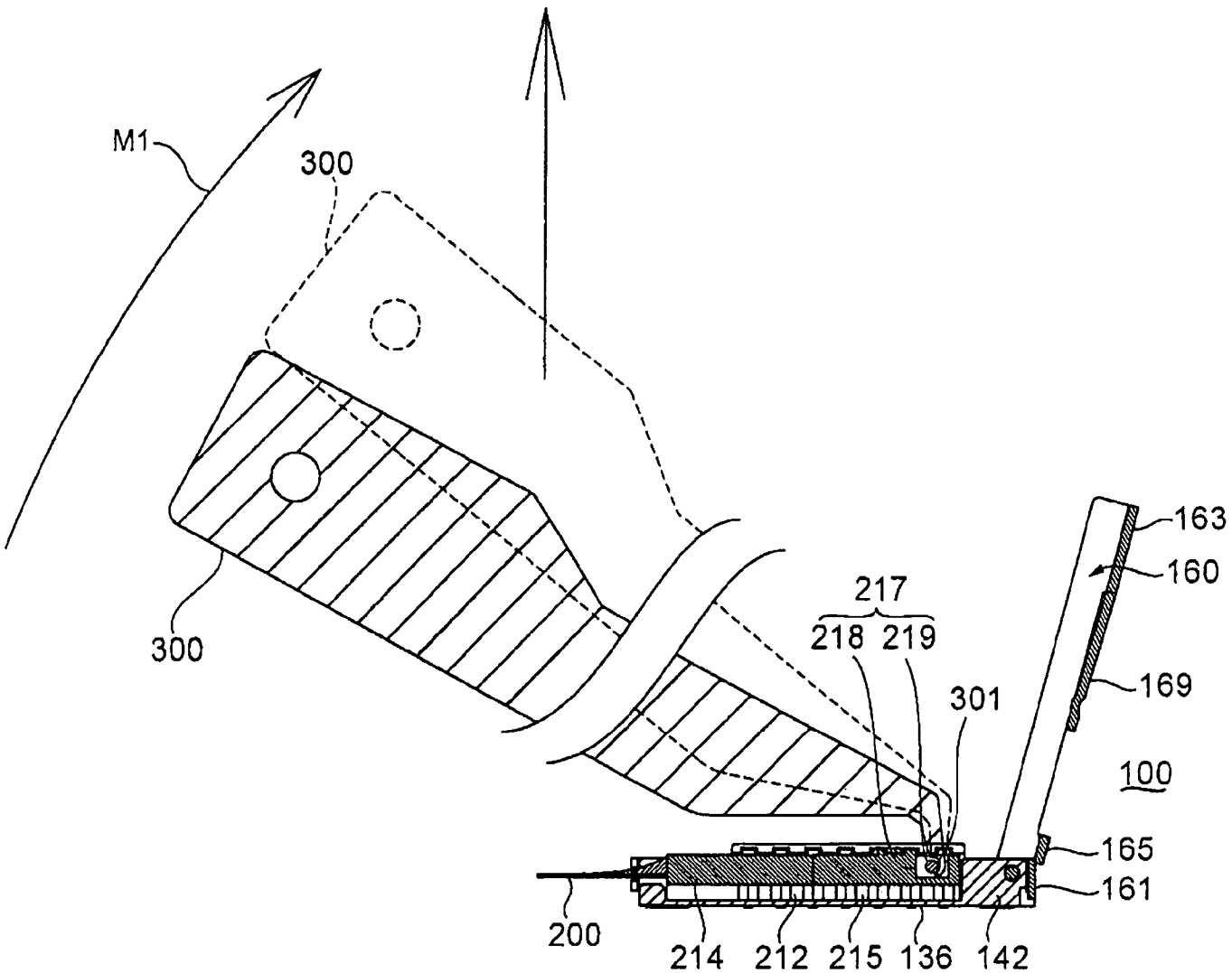
FIG. 12 shows the method of detaching a module from the electronic-component connector of the present invention.

FIG. 12 shows the method by which module 210 is detached from electronic-component connector 100 of the present invention.

In electronic-component connector 100 in which a module is mounted by fitting, the module is detached using lifting fixture 300 that is inserted into hollow portion 218 and that has distal end portion 301 capable of locking onto a shaft, as shown in FIG. 12. Specifically, distal end portion 301 has a shape that corresponds to hollow portion 218 to enable distal end portion 301 to be inserted into hollow portion 218, and the distal end of distal end portion 301 narrows and curves downward towards the distal end so as to have a circular arc cross-section herein.

Distal end portion 301 of this type of lifting fixture 300 is inserted into the hollow portion, lifting fixture 300 is engaged with shaft 219 disposed in hollow portion 218, and distal end portion 301 is rotated about engaged shaft 219 in the direction indicated by arrow M1 (upward). Module 210 thereby moves in the direction away from open portion 110—the opposite direction from the insertion direction—and can easily be removed from open portion 110 of electronic-component connector 100.

Thus, according to Embodiment 1, module 210, which is a signal-transmitting member, is inserted into open portion 110, optical waveguide 200 is guided to the outside of connector body 130 via lead-out path 130*c* of the lead-out portion, and module 210 is fixed to connector body 130 while connected in a state in which optical waveguide 200 extends from one side. Therefore, electronic-component connector 100 can reliably fix module 210 in a state of electrical connection in the contact portion without touching or retaining optical waveguide 200. Shock such as vibration imparted to the mounting substrate on which electronic-component connector 100 is mounted are therefore prevented from causing misalignment, disconnection, or fretting at the position of contact with module 210.

In module connector 100, module 210 is connected in a state in which optical waveguide 200 of the signal extends from one side. Therefore, there is no need to form a connection using wiring that is attached separately to optical waveguide 200 and module 210, optical waveguide 200 and module 210 can be connected to each other within connector body 130, and the packaging space can be reduced in size. The detachability also enables easy maintenance.

An electronic component that is connected to module connector 100 can thus be securely and detachably connected in a small packaging space even when module 210 is, for example, coupled with optical waveguide 200 of the signal such as of an optical waveguide, and is used to transmit and receive a signal such as an optical signal via optical waveguide 200.

Since connected module 210 connects an optical waveguide, module 210 can be fixed without misalignment with respect to module connector 100, contact with the optical waveguide, or retention of the optical waveguide, and an electrical signal can be smoothly transmitted.

Free-end portion 169*a* of pushing member 169 comes into contact with the substantial center portion of module 210 inserted into open portion 110, and presses on module 210, and thereby the pressing force is transmitted to the entire area of contact between the connection terminals of module 210 and the contact terminals of connector body 130. Accordingly, module 210 can be reliably fixed in a state of electrical connection in the contact area without touching optical waveguide 200 or retaining optical waveguide 200.

Pushing member 169 is made up of a leaf spring member that extends at an angle downward from installation plate portion 163. Therefore, module 210 can be pushed in the insertion direction, connection between the connection terminals and the contact terminals can be ensured, a signal can be smoothly transmitted, and connection between connection terminals 215 and socket contacts (contact terminals)

120 can be ensured by a simple structure in a state in which the height level of installation plate portion 163 is maintained.

By using a resin to mold cover member (fixing portion) 160, it is possible to achieve reduction of manufacturing cost.

Cover member 160 herein is electrically conductive, and, when module 210 is fixed, cover member 160 comes into contact with electrically conductive module case 214 of module 210, and is connected to leads 134*a*. In other words, module 210 is provided with electrically conductive module case 214, and thereby module 210 is electrically connected to cover member 160 and leads 134*a*, and is made conductive relative to leads 134*a*. When module 210 is accommodated and fixed in open portion 110 of connector body 130 mounted on the substrate, module 210 as such is electrically connected to the ground portion of the substrate and is made conductive relative to the ground portion via leads 134*a*. The leads are electrically connected to the ground portion of the substrate.

Protrusion 134*e* and locked portion 166 engage with each other, and thereby module 210 in open portion 110 of the housing is electrically connected to and made conductive relative to the fixed terminal portions of leads 134*a* of shield case 134 via protrusion 134*e*, locked portion 166, and pushing member 169 of cover member 160 that comes into contact with module case 214. Module case 214 of module 210 is thereby made conductive relative to the ground portion of the substrate when connector body 130 is mounted on the substrate.

Accordingly, during operation of module 210 connected to module connector 100—during operation of module 210 as such—, noise that is generated by this operation is absorbed by module case 214 and is conducted to the ground portion of the substrate via cover member 160 and leads 134*a*. Specifically, merely by mounting module connector 100 on the substrate, noise can be prevented from leaking to module connector 100 during operation of module 210 connected to module connector 100.

Embodiment 2

Figure 13:
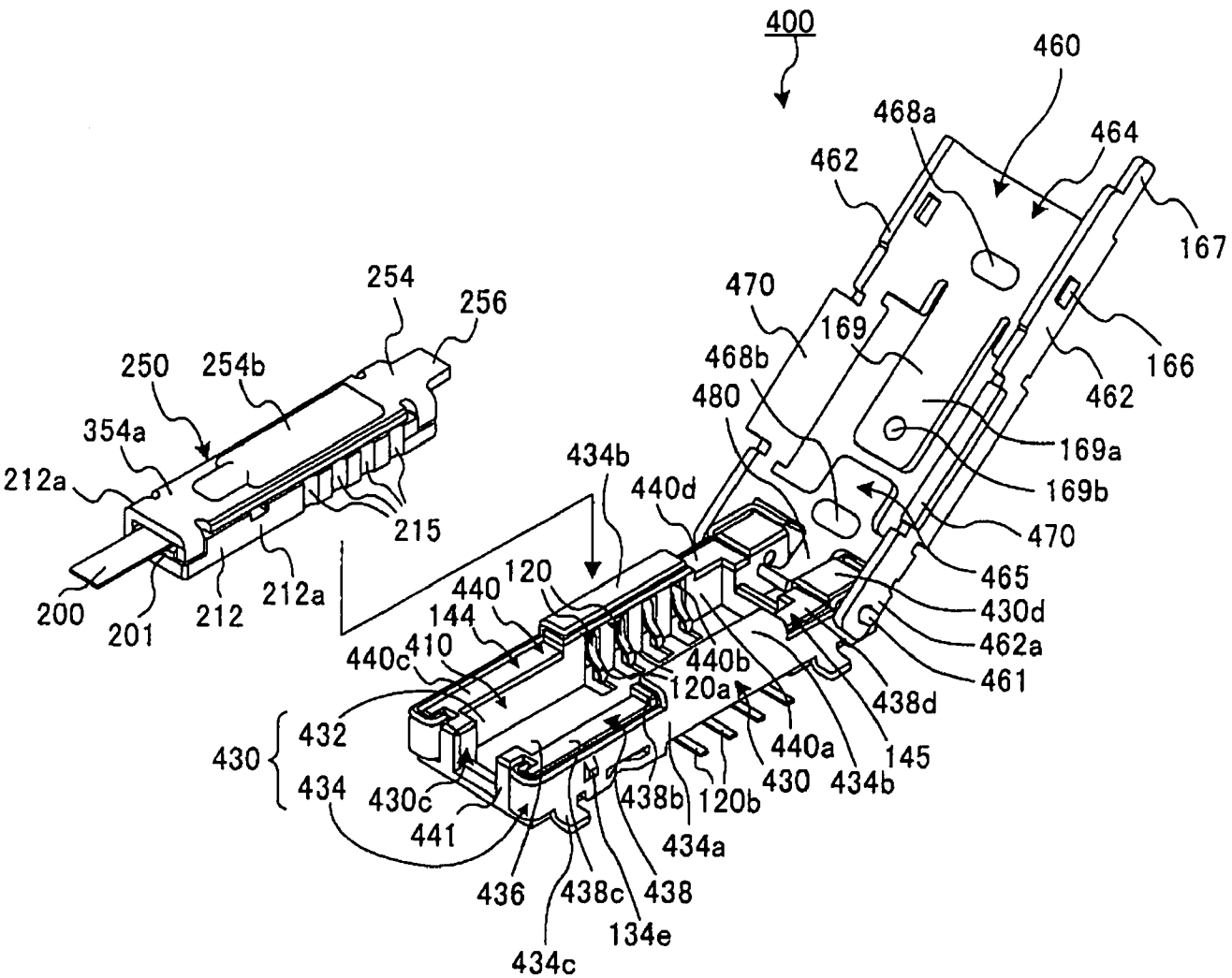
FIG. 13 shows the structure of the electronic-component connector according to Embodiment 2 of the present invention.
Figure 14:
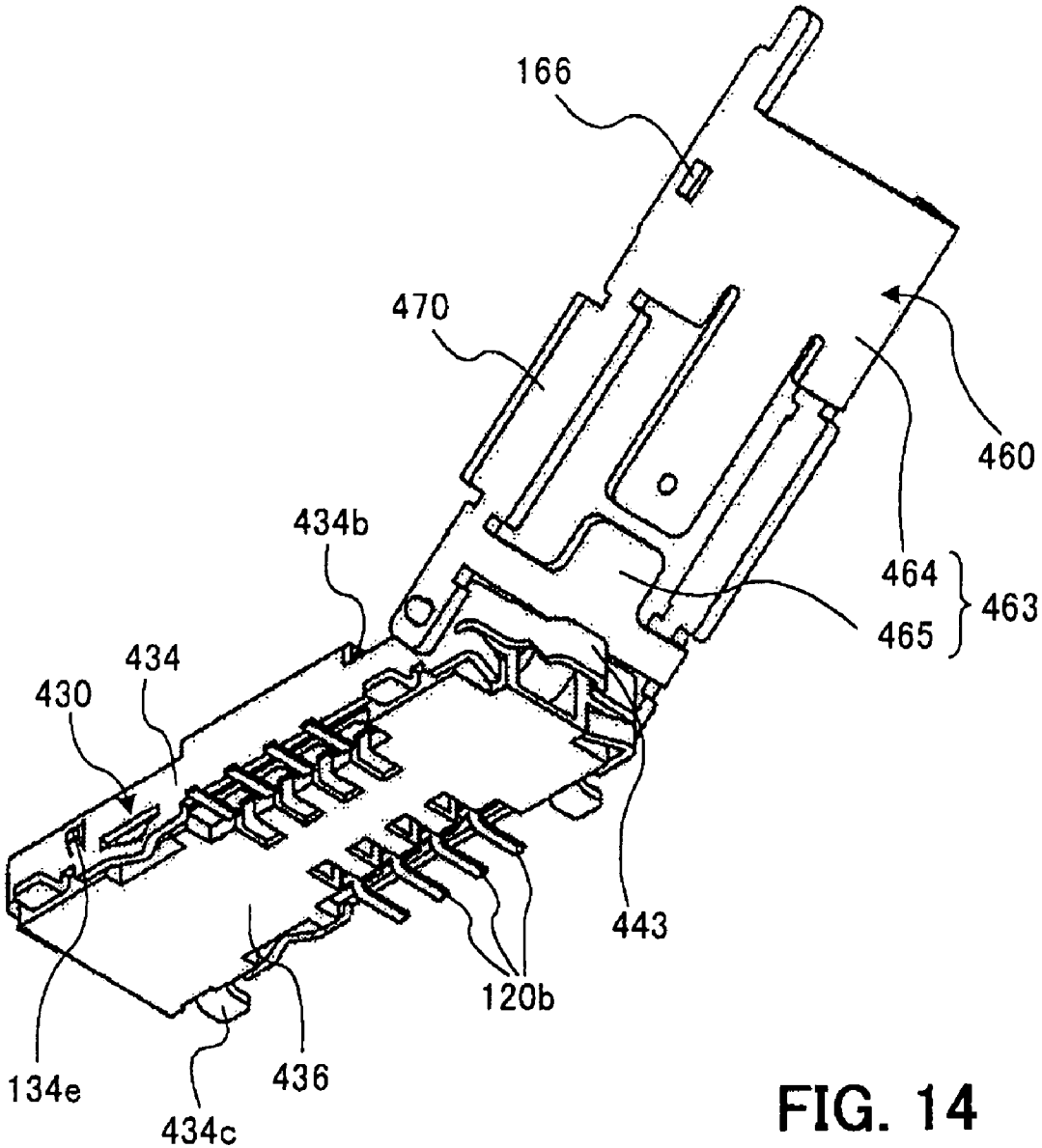
FIG. 14 shows the electronic-component connector according to Embodiment 2 of the present invention shown in FIG. 13 as viewed from a bottom.

FIG. 13 shows the structure of electronic-component connector 400 according to Embodiment 2 of the present invention. FIG. 14 is a bottom view of electronic-component connector 400 according to Embodiment 2 of the present invention shown in FIG. 13. Module 250 to which optical waveguide 200 is attached will be used in the description as the electronic component that is connected to electronic-component connector 400. As in the case of module 210 in Embodiment 1, the electronic component is not limited to a module equipped with an optical waveguide, and may also be a module or other component that is provided with an electric wire, a cable, a flexible cable or an optical fiber.

Electronic-component connector 400 shown in FIG. 13 accommodates and detachably connects module 250 for receiving the light of optical waveguide 200, converting the light to a voltage, and outputting the voltage. Optical waveguide 200 for guiding an optical signal is attached to module 250. Electronic-component connector 400 shields and protects accommodated module 250 from electric fields or magnetic fields from the outside.

Module 250 to which optical waveguide 200 is attached differs from module 210 only with respect to the structure of the module cover, and all other aspects of module 250 are the same as in module 210.

Accordingly, only the differing aspects will be described, the same names and reference symbols are used for structures that are the same, and such structures are not described.

In the same manner as in module 210, module 250 is provided with substrate 212 on which an optical signal processing section (not shown) is mounted that is attached to one end 201 of optical waveguide 200, and module case (exterior portion) 254 for covering the optical signal processing section (electronic component body) on substrate 212.

Substrate 212 of module 250 is provided with connection terminals (electrodes) 215 adjacent to the mounting surface (not shown) that output a voltage (electrical signal) converted by the optical signal processing section to two lateral surfaces 212*a* that extend in the extension direction of optical waveguide 200. Connection terminals 215 are provided so as to be exposed on two lateral surfaces 212*a*, and when the mounting surface of substrate 212 is the back surface in this arrangement, connection terminals 215 are disposed in a plurality of concave portions that are formed in side surfaces 212*a* so as to open to the front and sides of module 250. When the concave portions are formed orthogonally with respect to the surface portion of film-shaped optical waveguide 200, and are brought into electrical contact with electronic-component connector 400, module 250 is connected by inserting module 250 from the front side. In other words, module 250 is connected by inserting module 250 in a substantially vertical direction from above electronic-component connector 400.

Module cover 254 is formed by a conduction member that has electrically conductive, and is formed herein by machining a copper sheet or other metal sheet into a lid shape so that the optical signal processing section in which optical waveguide 200 extends from one side is covered from above. Module cover 254 thereby absorbs noise that is generated during operation of the optical signal processing section.

Module cover 254 also has retaining tab 256 that protrudes to the rear from the rear end portion of substrate 212. Retaining tab 256 forms an overhang with respect to substrate 212, and is in the shape of a plate that extends horizontally to the rear from upper surface portion 254*a* of module cover 254.

Retaining tab 256 is retained from below by ejecting tab (ejecting portion) 480 that is shifted upward—in the opposite direction from the insertion direction—by the rotation of cover member (lid portion) 460 (see FIG. 16).

Roof portion 254*b* that protrudes upward and extends in the longitudinal direction is also formed in the center portion of upper surface portion 254*a* of module cover 254. Roof portion 254*b* is positioned so as to be pressed by ejecting tab 480 of cover member 460 when module 250 is inserted into open portion 410, and cover member 460 is closed.

In the same manner as in module 210, module 250 configured as described above is fitted into open portion 410 of electronic-component connector 400 that opens upward, and thereby connection terminals 215 thereof are connected to socket contacts (contact terminals) 120 of electronic-component connector 400.

Electronic-component connector 400 has connector body 430 that has open portion 410 into which module 250 is inserted and fitted, and also has cover member (lid portion) 460 that is pivotally fitted to connector body 430 so as to be able to rotate, and that is used for covering module 250 (see FIG. 13) fitted into open portion 410. In the same manner as cover member 160, cover member 460 functions as a fixing portion of fixing module 250 that is fitted by being inserted into open portion 410 of connector body 430, to connector body 430.

Connector body 430 has housing (housing portion) 432 that has open portion 410, and shield case (shield portion) 434 disposed on the periphery of housing 432 and is used for shielding module 250 (see FIG. 13) that is fitted into open portion 410. The basic structure and function of housing 432 and shield case 434 in connector body 430 are the same as the structure and function of housing 132 and shield case 134 of connector body 130 of electronic-component connector 100 described above.

Specifically, in housing 432, two side wall portions 438 and 440 that face each other across a predetermined gap and extend in the longitudinal direction are provided on the top surface of rectangular plate-shaped bottom surface portion 436 that faces the mounting substrate, as shown in FIGS. 13 and 14.

Front wall portion 441 in which lead-out path 430*c* is formed is provided between the pair of side wall portions 438 and 440 at one end thereof (distal end portion in this case), and stopper portion 443 is disposed at the other end portion (proximal end portion in this case) between the pair of side wall portions 438 and 440.

Open portion 410 is shaped as an upward-opening trench by bottom surface portion 436, the pair of side wall portions 438 and 440, and front wall portion 441 in housing 432.

In the same manner as housing 132, housing 432 is formed from an insulation member that has insulating properties and is made from a synthetic resin such as insulating plastic.

In housing 432, socket contacts (contact terminals) 120 for contacting connection terminals 215 (see FIG. 13) of module 250 fitted into open portion 410 are provided to each of the opposing inner wall surface (only 440*a* is shown in FIG. 13) surfaces of open portion 410.

The structure of socket contacts 120 disposed at side wall portions 438 and 440 is the same as the structure of socket contacts 120 formed in side wall portions 138 and 140 of housing 132 of electronic-component connector 100. Specifically, socket contacts 120 in connector body 430 are made up of elongated plate-shaped members that are electrically conductive. Contact portions 120*a* on one end are arranged so as to protrude from the opposing inner wall faces (only opposing face 440*a* is shown in FIG. 13) of open portion 410.

Contact leads 120*b* at the other end are connected to contact portions 120*a*, and extend substantially parallel to the bottom surface of connector body 430—bottom surface portion 436—to the outside of connector body 430 via a plurality of holes formed in the lower surface of side wall portions 438 and 440 of housing 432.

Center portions (not shown) that connect contact portions 120*a* and contact leads 120*b* are embedded in side wall portions 438 and 440, and thereby socket contacts 120 are attached to side wall portions 438 and 440.

Contact portions 120*a* of socket contacts 120 are connected to module 250 in the same manner that contact portions 120*a* of socket contacts 120 of electronic-component connector 100 are connected to module 210. In other words, contact portions 120*a* are guided into the concave portions of substrate 212 in module 250 and are brought into contact with connection terminals 215 (see FIG. 13) of module 250 when module 250 is inserted from above into open portion 410 of electronic-component connector 400. Contact leads 120*b* are connected on the substrate when placed on the substrate on which electronic-component connector 400 is mounted.

Upper portions 438*b* and 440*b* in the position in which socket contacts 120 are provided have the highest elevation in the upper surfaces of side wall portions 438 and 440 of housing 432. In other words, in side wall portions 438 and 440, recessed portions 144 and 145 are formed in the upper portions (upper portions 438*c* and 440*c* on the distal end, and upper portions 438*d* and 440*d* on the proximal end) other than upper portions 438*b* and 440*b*, in the same manner as in housing 132.

Upper surface portions 438*c* and 440*c* on the distal end and upper surface portions 438*d* and 440*d* on the proximal end are in substantially the same height plane, and are in substantially the same height plane as the upper surface (back surface) of module 250 (see FIG. 13).

Figure 15:
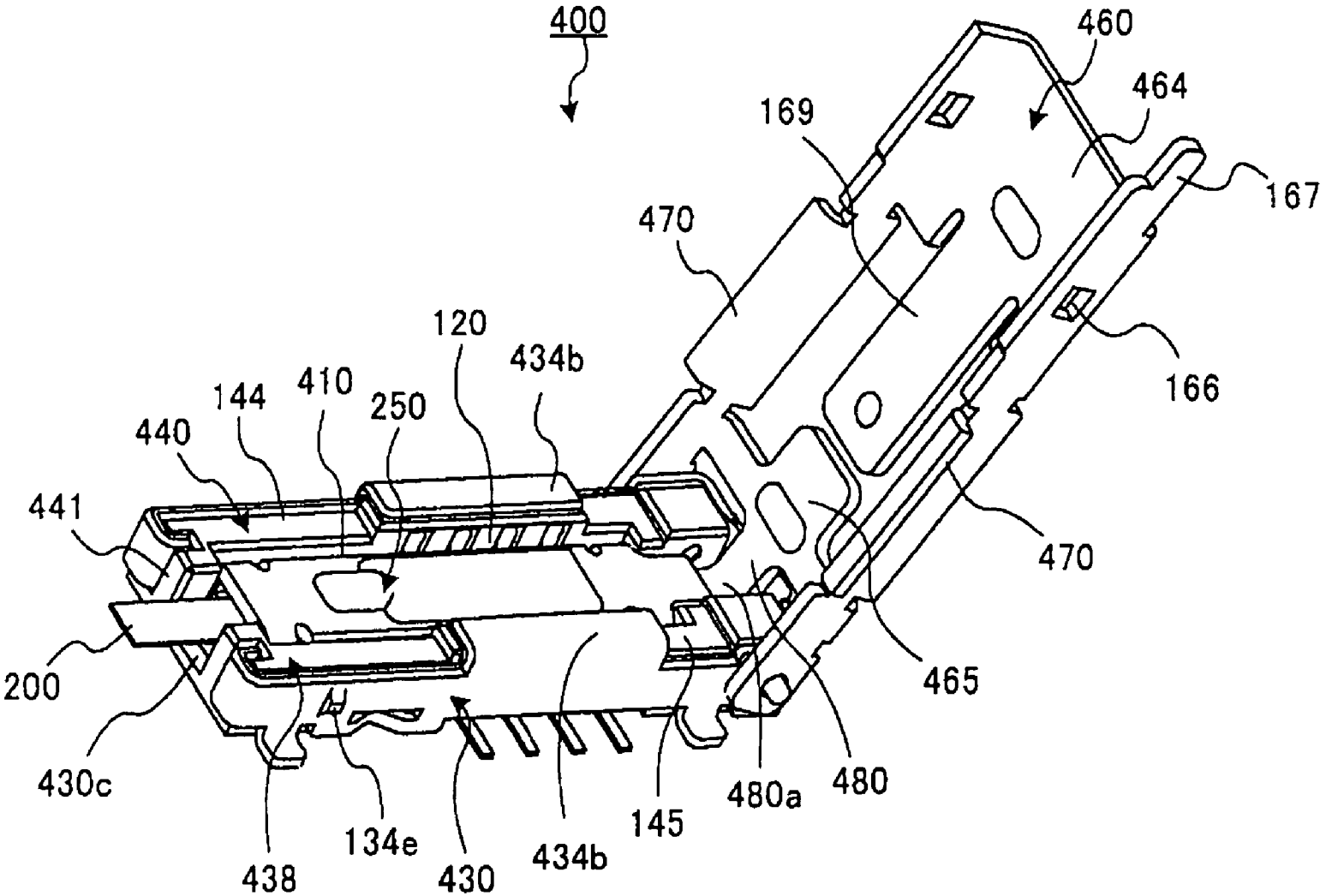
FIG. 15 is a perspective view showing a state in which a module is inserted and fitted into the open portion of the electronic-component connector in Embodiment 2 of the present invention.
Figure 16:
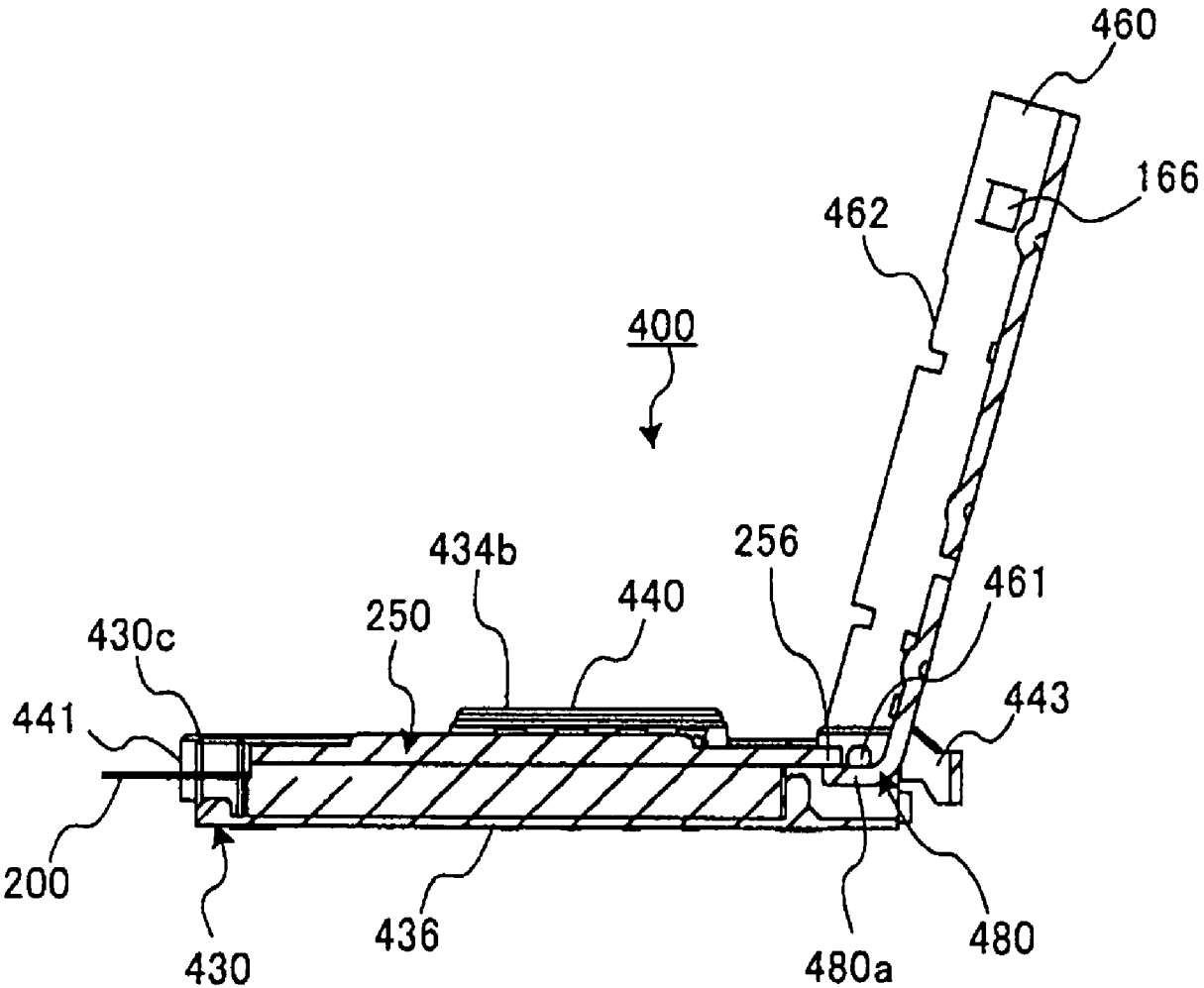
FIG. 16 is a sectional view showing a state in which a module is inserted and fitted into the open portion of the electronic-component connector in Embodiment 2 of the present invention.

FIG. 15 is a perspective view showing a state in which module 250 is inserted and fitted into open portion 410 of electronic-component connector 400 in Embodiment 2 of the present invention, and FIG. 16 is its sectional view.

As shown in FIGS. 15 and 16, module 250 fitted into open portion 410 is lower than the height at which socket contacts 120 are provided in side wall portions 438 and 440.

As in the case of side wall portions 138 and 140 of housing 132, socket contacts 120 are not provided directly below the portions in which recessed portions 144 and 145 are formed in side wall portions 438 and 440 of housing 432. Therefore, there is no need to maintain the height or strength needed when socket contacts 120 are provided to housing 432, so that it is possible to decrease the height level correspondingly.

A communicating groove that is communicated with the distal end of connector body 430 is formed in front wall portion 441, and lead-out path 430*c* as a lead-out portion for bringing out optical waveguide 200 (see FIG. 13) of module 250 (see FIG. 13) to the outside is formed by the communicating groove.

According to this configuration, when module 250 (see FIG. 13) is fitted into open portion 410, optical waveguide 200 of module 250 (see FIG. 13) is brought out to the outside of electronic-component connector 400 without being retained by electronic-component connector 400.

Shield case 434 (see FIG. 13) is formed by a conducting member that is electrically conductive, and is machined from a metal sheet in this case. Shield case 434 is disposed so as to cover housing 432 and to shield module 250 that is accommodated in open portion 410 of shield case 434.

Specifically, shield case 434 is provided with rectangular-frame-shaped case body 434*a* that is provided so as to surround housing 432 from the sides in the external peripheral portion of housing 432 that excludes the edge of lead-out path 430*c* in front wall portion 441.

Case body 434*a* has contact cover portions 434*b* (see FIGS. 13 and 15) formed therein that extend from the center portion of the upper edge of case body 434*a* and completely cover upper surfaces 438*b* and 440*b* in the area in which socket contacts 120 are provided in side wall portions 438 and 440 of housing 432.

Contact cover portions 434*b* are electrically conductive and plate-shaped, and are formed continuously with electrically conductive case body 434*a* so as to be conductive relative to case body 434*a*.

Case body 434*a* is fixed on the mounting substrate via leads 434*c* that are formed so as to extend sideways from the lower edge of case body 434*a*.

Leads 434*c* are fixed in an electrical connection to the ground portion of the substrate on which electronic-component connector 400 is mounted, in the same manner as leads 134*a* of electronic-component connector 100. In other words, leads 134*a* are fixed in a state of electrical connection to the GND land portion of the substrate by soldering or the like.

Shield case 434 formed using a conducting member is thereby electrically connected to the GND line of the substrate via leads 434*a* when electronic-component connector 400 is mounted on the substrate.

Module 250 (see FIG. 13) fitted into open portion 410 of connector body 430 thus configured is covered by cover member 460 after module 250 is inserted from the opening direction (above connector body 430) of open portion 410, and thereby module 250 is fixed in a state of electrical connection to connector body 430.

As shown in FIGS. 14 and 16, stopper portion 443 is provided to the rear of shaft portion 461 so as to bridge the proximal ends of side wall portions 438 and 440 of housing 432 in a direction that intersects the rotation range of cover member 460. Stopper portion 443 herein is electrically conductive and is formed by folding a plate-shaped material.

Stopper portion 443 is thus positioned in the rotation range of cover member 460 that is pivotally fitted by shaft portion 461 at the proximal end of shield case 434, and stopper portion 443 restricts the range of rotation of cover member 460. As shown in FIG. 14, stopper portion 443 is in contact with cover member 460 at the proximal end of cover member 460 when cover member 460 is opened at a predetermined angle with respect to connector body 430, and cover member 460 is retained in an open state at the predetermined angle.

Thus-configured cover member 460 that covers connector body 430 is made up of a conducting member that is electrically conductive, and is formed in this case by machining a metal sheet.

As shown in FIG. 13, cover member 460 has a pair of arm portions 462 that are attached to connector body 430 so as to be able to rotate about shaft portion 461, cover top portion 463 provided between the pair of arm portions 462, presser plate (pressing portion) 169 formed in cover top portion 463, and skirt portions 470 formed on arm portions 462.

Arm portions 462 are structured in substantially the same manner as arm portions 162. Specifically, arm portions 162 are positioned so as to cover the surfaces on both sides of connector body 430 when cover top portion 463 is placed on recessed portions 144 and 145, that is, when cover member 460 is closed, by rotating arm portions 462 about one-end portion 462*a*.

Similar to arm portions 162, arm portions 462 are also provided with locked portion 166 that engages with locking portion 134*e* formed in shield case 434 of connector body 430 when cover member 460 is closed and positioned so as to cover the surfaces on both sides of connector body 430.

Locking portion 134*e* and locked portion 166 are the same as those of electronic-component connector 100, and, when these components are engaged with each other, cover member 460 is fixed to connector body 430, and arm portions 462 and shield case 434 are connected to each other in a state of conduction.

Arm portions 462 and shield case 434 maybe configured so as to be conductive with respect to each other by contact rather than by engagement of portions thereof with each other when cover member 460 is closed over connector body 430. For example, it is apparent that a configuration may be adopted whereby the inner surfaces of arm portions 462 are in surface contact with the outer surface of shield case 434 when cover member 460 is closed over connector body 430.

As in arm portions 162, operation member 167 (see FIGS. 13 through 15) for facilitating the opening and closing of cover member 460 is provided to arm portion 462.

This cover member 460 differs from cover member 160 of electronic-component connector 100 in that skirt portions 470 are formed in arm portions 462 to cover contact leads 120*b* from above when cover member 460 is closed over connector body 430.

Figure 17:
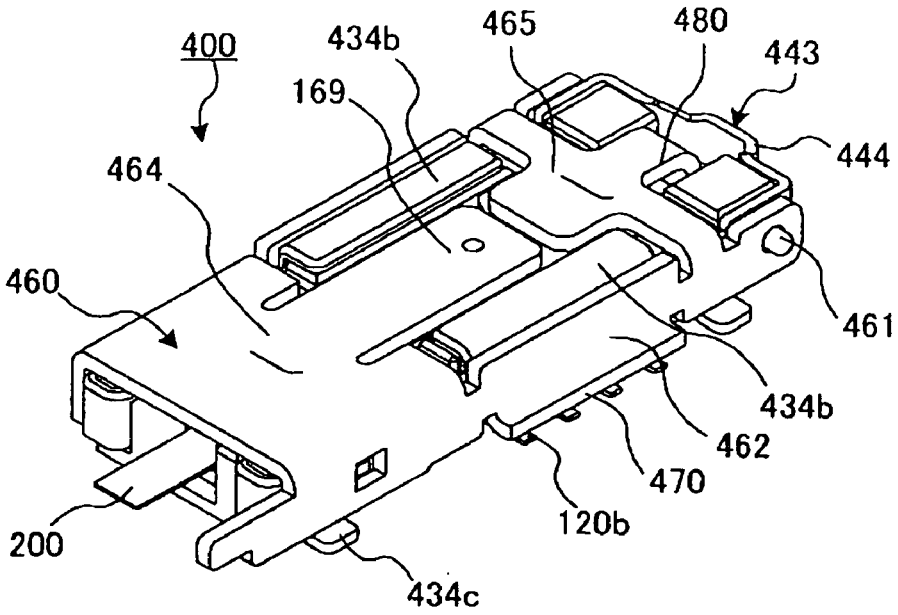
FIG. 17 is a perspective view showing a state in which the cover member is closed and the module is housed in the electronic-component connector according to Embodiment 2 of the present invention.
Figure 18:
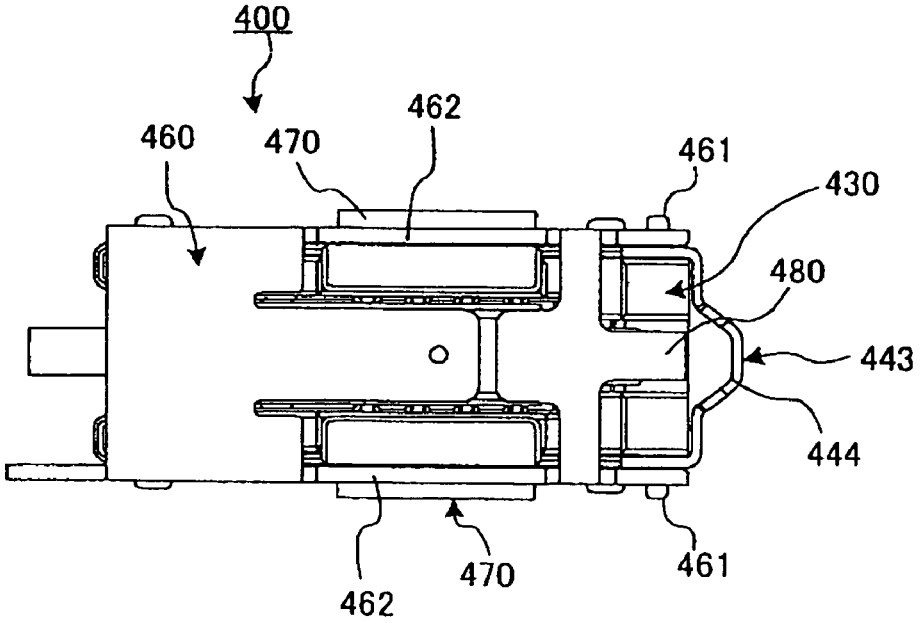
FIG. 18 is a top view showing a state in which the cover member is closed and the module is housed in the electronic-component connector according to Embodiment 2 of the present invention.

FIG. 17 is a perspective view showing a state in which cover member 460 is closed and module 250 is housed in electronic-component connector 400 according to Embodiment 2 of the present invention, and FIG. 18 is a top view of the same state.

Skirt portions 470 are in the shape of panels that extend substantially horizontally to both sides (left and right directions) from the lower edges of each of the pair of arm portions 462, and are positioned adjacent to the areas directly above contact leads 120*b* when cover member 460 is closed over connector body 430. For example, skirt portions 470 are formed in each of arm portions 462 so as to be positioned about 0.2 and 0.25 mm above contact leads 120*b* when cover member 460 is in the closed state.

In this arrangement, skirt portions 470 are longer in the longitudinal direction than contact leads 120*b* provided to connector body 430. When cover member 460 is closed, contact leads 120*b* are completely covered as shown in FIG. 18, and are not visible.

Skirt portions 470 were described as being formed in the shape of substantially horizontal panels that are each orthogonal to arm portions 462, but this configuration is not limiting, and skirt portions 470 may be formed in any manner insofar as skirt portions 470 cover contact leads 120*b* from above when cover member 460 is closed.

For example, skirt portions 470 may be made up of a horizontal plate portion that extends substantially horizontally from the lower edges of arm portions 462, and a vertical plate portion that extends orthogonally downward from the distal end of the horizontal plate portion. Specifically, the horizontal plate portion is folded at the distal end thereof to form the vertical plate portion, and when cover member 460 is closed with respect to connector body 430, contact leads 120*b* are covered from above by the horizontal plate portion, and the distal ends of contact leads 120*b* are covered by the horizontal plate portion. At this time, the horizontal plate portion and the vertical plate portion are both disposed adjacent to contact leads 120*b*, and do not touch contact leads 120*b*.

When small-sized module 250 is mounted to an electronic equipment or the like via electronic-component connector 400 and used, electromagnetic noise that creates electromagnetic interference (EMI: Electro Magnetic Interference) with another component or another equipment that is near the electronic equipment readily occurs due to the signal current when the operating frequency of the signal flowing to and from module 250 increases.

Skirt portions 470 prevent the EMI-generating electromagnetic noise from originating in contact leads 120*b*.

As shown in FIG. 13, cover top portion 463 has distal-end upper surface portion (upper surface portion) 464 disposed at the distal end between the pair of arm portions 462, and proximal-end upper surface portion (upper surface portion) 465 disposed at the proximal end between the pair of arm portions 462. Distal-end upper surface portion 464 has basically the same function as installation plate portion 163, and proximal-end upper surface portion 465 has basically the same function as reinforcing installation plate portion 165.

When cover member 460 is closed, distal-end upper surface portion 464 is disposed on recessed portions 144 in connector body 430, that is, upper surface portions 438*c* and 440*c* on the distal end.

When cover member 460 is closed, proximal-end upper surface portion 465 is disposed on recessed portion 145 in connector body 430, that is, on upper surface portions 438*d* and 440*d* on the proximal end.

Distal-end upper surface portion 464 and proximal-end upper surface portion 465 deter movement of module 250 (see FIG. 13) towards the surface—upward from connector body 430—in a state in which module 250 (see FIG. 13) is fitted into open portion 410 and is electrically connected to connector body 430.

Distal-end upper surface portion 464 and proximal-end upper surface portion 465 are positioned in the same plane, and ribs 468*a* and 468*b* (see FIG. 13) are provided so as to protrude from the back surfaces of distal-end upper surface portion 464 and proximal-end upper surface portion 465, respectively.

Ribs 468*a* and 468*b* are formed so as to protrude to the same degree from distal-end upper surface portion 464 and proximal-end upper surface portion 465, and, when cover member 460 is closed, ribs 468*a* and 468*b* make contact with the back surface of module 250 fitted into open portion 410, and position module 250 substantially horizontally.

Presser plate 169 for pressing down (toward the socket contacts) module 250 (see FIG. 13) fitted into open portion 410 from the upper surface (back surface) thereof is provided to distal-end upper surface portion 464. Similar to presser plate 169 in cover member 160, presser plate 169 has a flexible plate such as a leaf spring formed in cover member 460 that has the same function as presser plate 169 in cover member 160. Presser plate 169 also extends at an angle downward toward proximal-end upper surface portion 465 from the edge of the proximal end of distal-end upper surface portion 464. Free-end portion 169*a* thereof is provided at the substantial center of the module fitted into open portion 410.

Hemispherical contacting convex portion 169*b* (see FIG. 11) that protrudes downward is formed on the lower surface of free-end portion 169*a*. Contacting convex portion 169*b* makes contact with roof portion 254*b* of module 250 inserted into open portion 410, and presses against module 250.

Proximal-end upper surface portion 465 differs from reinforcing installation plate portion 165 formed in the same manner in cover member 160 of Embodiment 1 in that ejecting tab (ejecting portion) 480 is provided to proximal-end upper surface portion 465.

As shown in FIGS. 15 and 16, ejecting tab 480 extends in the longitudinal direction toward the proximal end of connector body 430 from the edge of the proximal end of proximal-end upper surface portion 465 and folds downward, and free-end portion 480*a* on the distal end is disposed further toward the proximal end of connector body 430 than shaft portion 461.

Ejecting tab 480 shifts shaft portion 461 to the center in conjunction with the opening and closing of cover member 460, and free-end portion 480*a* at the distal end thereof can move in and out of open portion 410 at the distal end from behind (the proximal end) shaft portion 461.

In other words, ejecting tab 480 protrudes into open portion 410 and ejects module 250 fitted into open portion 410 towards the opening when cover member 460 is rotated in the opening direction to or beyond a prescribed angle with respect to connector body 430.

In this arrangement, ejecting tab 480 shifts position in conjunction with the rotation of cover member 460 in the opening direction with respect to open portion 410 so as to protrude into open portion 410, and comes into contact with the back surface of retaining tab 256 of module 250 that is disposed at the proximal end of open portion 410. Cover member 460 is rotated further in the opening direction, and thereby the free-end portion at the distal end of ejecting tab 480 continues to press the retaining tab upward from the back surface.

Ejecting tab 480 is not positioned in open portion 410 when cover member 460 restricted by the stopper portion is positioned at an angle of 90 degree or larger with respect to connector body 430. Ejecting tab 480 thus does not hinder insertion of module 250 during insertion of module 250 into open portion 410 of connector body 430.

The method of connecting the electronic-component connector and the module equipped with an optical waveguide will next be described.

As shown in FIG. 13, cover member 460 of electronic-component connector 400 is opened, and module 250 to which optical waveguide 200 is connected is inserted from the front side of module 250—from the substrate side—into upwardly exposed trench-shaped open portion 410 of connector body 430 from above connector body 430. When cover member 460 is open, the rotation position of cover member 460 is limited by the stopper portion in a state in which cover member 460 is open at an angle of 90 degree or larger with respect to connector body 430. Situations are thereby prevented in which cover member 460 opens too far, falls over so that the back surface is directed upward, and touches another electronic component when module 250 is inserted into open portion 410.

When module 250 is inserted into open portion 410, contact portions 120*a* of socket contacts 120 of connector body 430 are each brought out and caused to come into contact with corresponding concave connection terminals (electrode portions) 215 on the surfaces of both sides of substrate 212 in module 250. Module 250 is fitted into open portion 410 with connection terminals 215 and contact portions 120*a* in contact with each other.

The state in which module 250 is fitted into electronic-component connector 400 is the same as the state in which module 210 shown in FIG. 6 is fitted into electronic-component connector 100, and description thereof is therefore omitted.

After module 250 is fitted into open portion 410 of connector body 430, cover member 460 is closed, distal-end upper surface portion 464 is placed on recessed portions 144, and protrusion 134*e* of shield case 434 is engaged with latch hole 166 of cover member 460, and thereby distal-end upper surface portion 464 is fixed on connector body 430.

Connection terminals 215 of module 250 may also be positioned on contact portions 120*a* of socket contacts 120, or module 250 may be in a tentatively inserted state that can guide contact portions 120*a*, by the concave portions of connection terminals 215, and cover member 460 may be closed.

Cover member 460 is thus placed in a closed state with respect to connector body 430 so as to cover open portion 410, and thereby module 250 is accommodated in electronic-component connector 400 (see FIG. 17). At this time, distal-end upper surface portion 464 is positioned over the back surface of the distal end of module 250, and proximal-end upper surface portion 465 is positioned over the back surface of the proximal end of module 250.

Since presser plate 169 extends from distal-end upper surface portion 464 to the proximal end of cover member 460 while tilting downward, module 250 is pressed from the substantial center portion of the back surface thereof when module 250 is fitted into open portion 410, and cover member 460 is closed (see FIG. 9). This pressing force is transmitted to the entire area of contact (see FIG. 6) between socket contacts 120 and connection terminals 215 of module 250.

Distal-end upper surface portion 464 is thus positioned over the distal end of module 250, thereby preventing movement in the direction away from open portion 410 of module 250, that is, from connector body 430.

In the back surface of module 250, the back surface portions at the distal end and the proximal end, between which the center portion is pressed by presser plate 169, are each pressed by ribs 468*a* and 468*b* that protrude to the same degree on the back surfaces of distal-end upper surface portion 464 and proximal-end upper surface portion 465, respectively.

Since the distal end and the proximal end of upper surface portion 254*a* of module 250 are therefore simultaneously pressed downward, module 250 is accommodated in open portion 410 in substantially horizontal fashion without tilting in the longitudinal direction.

Accordingly, merely by closing cover member 460, module 250 is reliably fixed in an electrical connection to connector body 430 in the contacting portion thereof without optical waveguide 200 being touched or retained.

Shock such as vibration imparted to the mounting substrate on which electronic-component connector 400 is mounted can therefore be prevented from causing misalignment, disconnection or fretting at the position of contact with module 250. Specifically, in the structure in which there is a connection between electronic-component connector 400 of the present embodiment and module 250 that has an optical waveguide, an electrical signal can be transmitted smoothly without module 250 becoming misaligned with respect to electronic-component connector 400.

In electronic-component connector 400, the upper portion of connector body 430 is recessed, except the area in which socket contacts 120 are provided, and distal-end upper surface portion 464 and proximal-end upper surface portion 465 of cover member 460 are positioned in recessed portions 144 and 145. Therefore, the height of upper surface 463 of cover member 460 that is formed by distal-end upper surface portion 464 and proximal-end upper surface portion 465 disposed on recessed portions 144 and 145, respectively, can be made equal to the height of socket contacts 120 (that is, the height of the position in which socket contacts 120 are provided in connector body 430). The height of electronic-component connector 400 as a whole can thereby be minimized, and a lower profile can be obtained.

Module 250 fitted into connector body 430 is thus covered by cover member 460, and thereby module 250 is accommodated in electronic-component connector 400, and a structure in which module 250 and electronic-component connector 400 are connected to each other is thereby formed.

Furthermore, module 250 in open portion 410 is fixed in electronic-component connector 400 in a state in which the upper surface of electrically conductive module cover 254 is in contact with contacting convex portion 169*b* on the back surface of free-end portion 169*a* of electrically conductive presser plate 169.

In cover member 460 that has presser plate 169, latch hole 166 provided to arm portion 462 engages with protrusion 134*e* of shield case 434. Cover member 460 and shield case 434 are therefore electrically connected and in contact with each other through the engagement of latch hole 166 with protrusion 134*e*.

Specifically, in the state in which module 250 is mounted to electronic-component connector 400, module cover 254 is made conductive relative to shield case 434 of connector body 430 via cover member 460. Connector body 430 is mounted on the substrate through connection to the GND land portion of the substrate mounted via leads 434*c* of shield case 434.

Cover member 460 is closed and latch hole 166 is caused to engage with protrusion 134*e*, and thereby module 250 is electrically connected and made conductive relative to the ground portion of the substrate via shield case 434 that includes protrusion 134*e* and leads 434*c*, and via cover member 460 that includes module cover 254, presser plate 169 and latch hole 166.

Module cover 254 of module 250 is thereby connected to the GND land portion of the substrate and is made conductive relative to the ground portion of the substrate when the connector body is mounted on the substrate.

Accordingly, during operation of module 250 connected to the electronic-component connector, noise that is generated by this operation is absorbed by module cover 254 and transmitted to the ground portion of the substrate via cover member 460 and shield case 434. Noise leakage during operation of module 250 can thereby be prevented. At this time, there is no need to provide separate noise-prevention wiring or the like to prevent noise leakage during operation of module 250, and noise leakage can be prevented merely by mounting the connector body on the substrate by fixing leads 434*c* of shield case 434 in a state of connection to the ground portion.

As shown in FIG. 17, when module 250 is inserted into open portion 410, and cover member 460 is lowered and closed in electronic-component connector 400, skirt portions 470 are positioned adjacent to the areas directly above contact leads 120*b* of connector body 430.

In this configuration, even when a high-speed signal flows to contact leads 120*b* during operation of module 250, and noise is emitted from contact leads 120*b*, the noise is absorbed by skirt portions 470 that are positioned adjacent to the areas directly above contact leads 120*b*. Contact leads 120*b* are completely covered from above by skirt portions 470 as shown in the over head view of FIG. 18, and are not visible.

In other words, since skirt portions 470 are provided to cover member 460, a state is created in which skirt portions 470 are grounded to the GND land of the mounting substrate via cover member 460 and the leads of shield case 434 of connector body 430. Skirt portions 470 can thereby prevent situations in which electromagnetic interference (EMI: Electro Magnetic Interference) brought about by the emission and transmission of electromagnetic noise (electromagnetic waves) leaks from contact leads 120*b*.

A case of disconnecting module 250 from electronic-component connector 400 to which module 250 is electrically connected will next be described.

Figure 19:
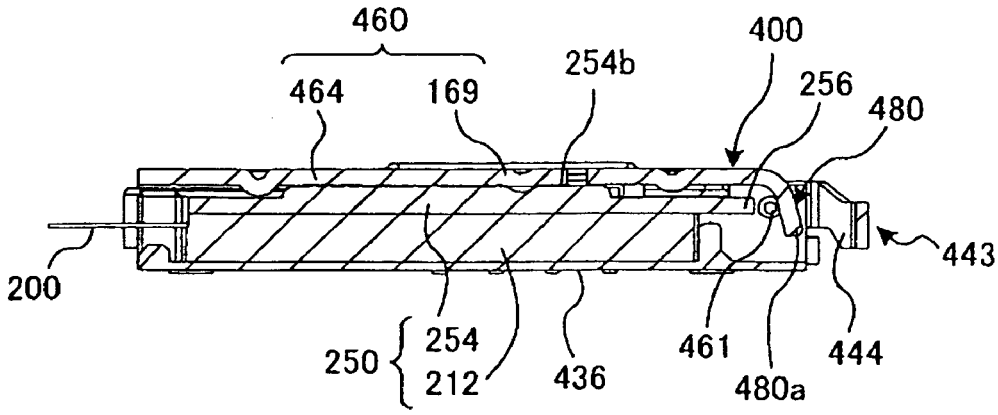
FIG. 19 is a sectional side view of the electronic-component connector in the state shown in FIG. 17.
Figure 20:
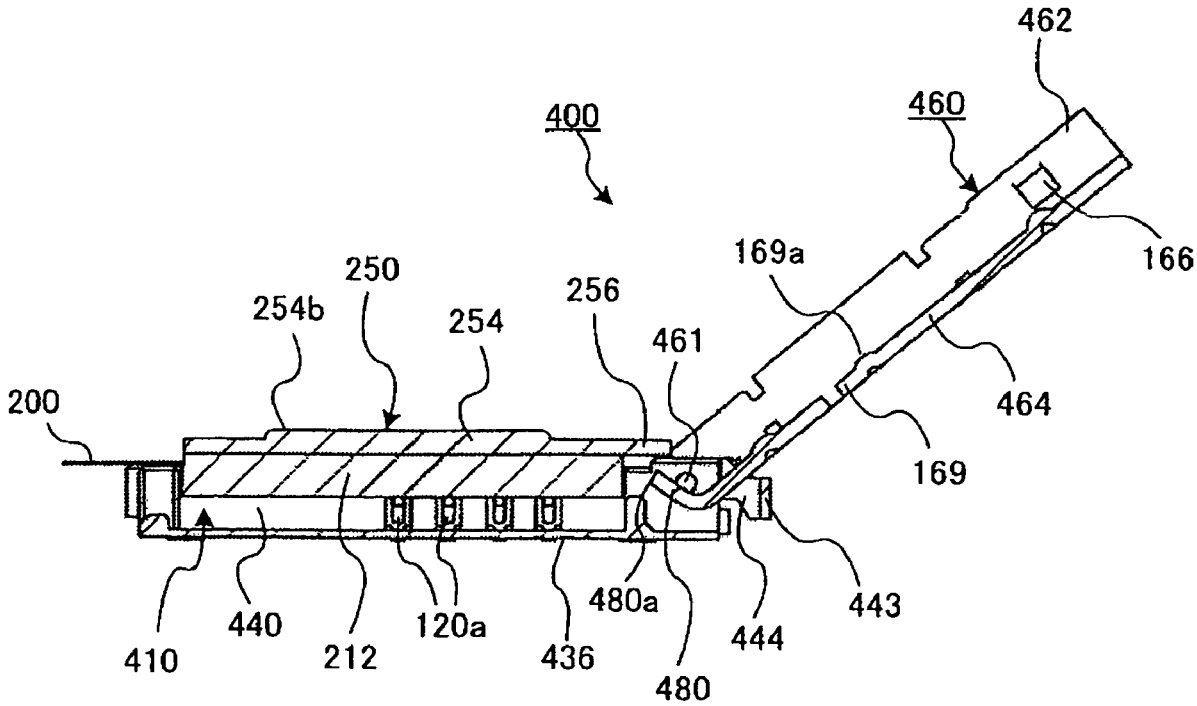
FIG. 20 is a sectional side view showing a state in which the cover member is completely open in the electronic-component connector according to Embodiment 2 of the present invention.

FIG. 19 is a sectional side view of electronic-component connector 400 in the state shown in FIG. 17, and FIG. 20 is a sectional side view showing a state in which cover member 460 is completely open in electronic-component connector 400.

When module 250 attached to electronic-component connector 400 shown in FIG. 19 is removed, protrusion 434*e* are first disengaged latch hole 166, lever 167 is moved upward, and cover member 460 is opened. In other words, cover member 460 is rotated in the opening direction about shaft portion 461.

Ejecting tab 480 that extends from proximal-end upper surface portion 465 shifts downward from the rear end side of shaft portion 461 along the external periphery of shaft portion 461 in conjunction with the rotation of cover member 460 in the opening direction.

When cover member 460 is open at a predetermined angle with respect to connector body 430, ejecting tab 480 of cover member 460 protrudes into open portion 410 from below and comes into contact with retaining tab 256 on the proximal end of module 250, as shown in FIG. 16. In other words, when cover member 460 is rotated, and the distal ends of arm portions 462 are separated by a predetermined distance from connector body 430, ejecting tab 480 formed at the proximal end of cover member 460 is retained by retaining tab 256 of module 250.

At this time, the angle formed by cover member 460 and the upper surface of connector body 430 is 90 degree or larger as viewed from the side.

Cover member 460 is then rotated further in the opening direction, and thereby ejecting tab 480 pushes retaining tab 256 upward—in the opposite direction from the insertion direction of module 250—and ejects module 250 upward from open portion 410, as shown in FIG. 20.

Connection terminals (electrode portions) 215 provided to the sides of substrate 212 of module 250 are thereby disengaged from contact portions 120*a* of socket contacts 120, and module 250 as such is separated from connector body 430.

Ejecting tab 480 herein is retained with respect to retaining tab 256 at an angle of about 410 degree with respect to the upper surface of the connector body of cover member 460 as viewed from the side, and is formed in cover member 460 so as to rise to a maximum angle of about 440 degree.

A state also occurs in which connection terminals 215 of module 250 that is separated from connector body 430 are placed on contact portions 120*a*.

According to this configuration, module 250 can be separated from electronic-component connector 400 merely by rotating cover member 460 in the opening direction when module 250 is detached from electronic-component connector 400 in which module 250 is accommodated.

There is no need for lifting fixture 300 such as the one shown in FIG. 12, and module 250 can be removed from electronic-component connector 400 even in cases in which lower profile and smaller size are achieved for module 250 and electronic-component connector 400.

Module 250 can be detached from connector body 430 by moving cover member 460 in the opening direction with respect to connector body 430. Therefore, there is no need to form a protrusion, hollow portion 218 and shaft 219, or other component whereby lifting fixture 300 is inserted and locked on the back surface of module 250. There is therefore no need to create a feature on the back surface of module 250 for ejection, and a further reduced profile can be obtained in module 250 as such.

The risk of module 250 as such being subjected to stress is small in comparison to a configuration in which module 250 is ejected from electronic-component connector 400 using a fixture.

When module 250 is detached from electronic-component connector 400, ejecting tab 480 of cover member 460 is in contact with retaining tab 256 of module cover 254 until module 250 separates from open portion 410. Module 250 can thereby be grounded to the GND land of the substrate via shield case 434 of cover member 460 until immediately before module 250 is ejected and completely separates from electronic-component connector 400. Static charge can thereby be conducted to the ground portion of the substrate even when the charge is generated during detachment of module 250.

When cover member 460 is rotated further in the opening direction—in the direction in which the distal ends of arm portions 462 separate from connector body 430—, the movement of cover member 460 is restricted by stopper portion 443.

Stopper portion 443 is provided to connector body 430 so that the angle formed by connector body 430 and cover member 460 rotated in the opening direction with respect to connector body 430 is less than 480 degree and larger than or equal to 440 degree.

Figure 21:
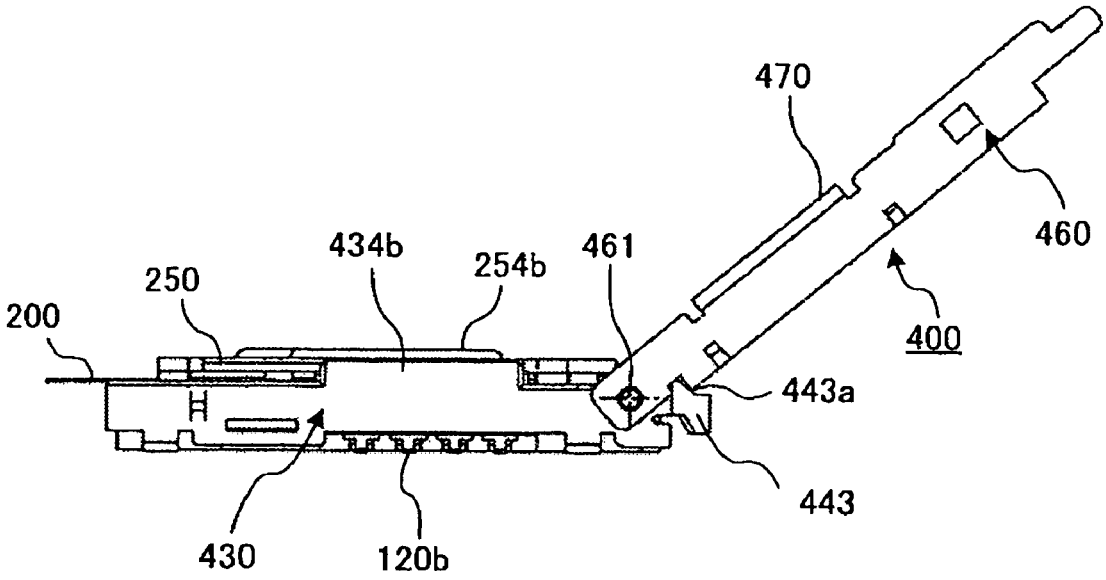
FIG. 21 is a sectional side view of the electronic-component connector shown in FIG. 20.
Figure 22:
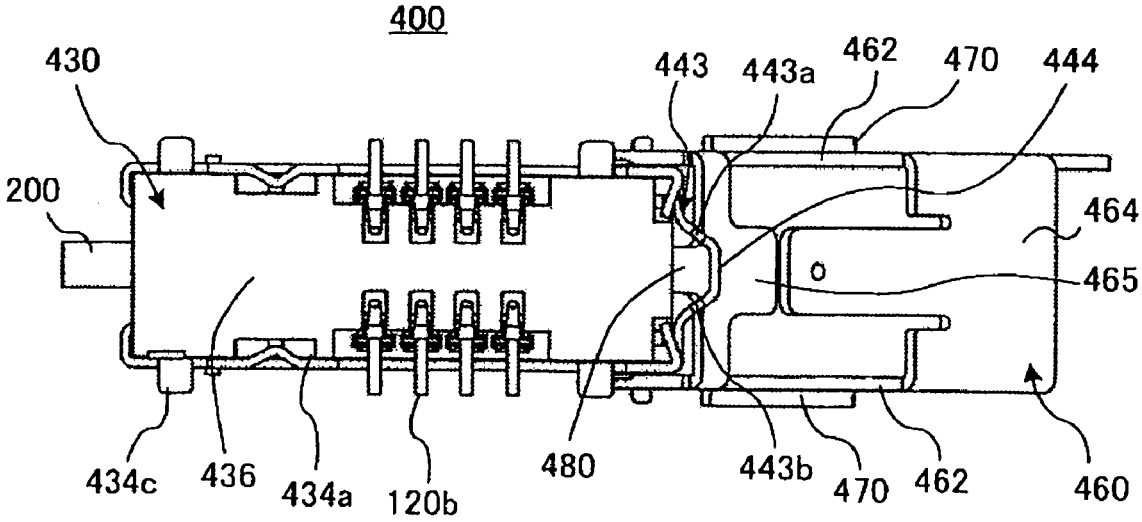
FIG. 22 is a bottom view of the electronic-component connector shown in FIG. 20.

FIG. 21 is a side view of electronic-component connector 400 shown in FIG. 20, and FIG. 22 is a bottom view of electronic-component connector 400 shown in FIG. 20.

As shown in FIGS. 21 and 22, proximal-end upper surface portion 465 of cover member 460 is in contact with stopper portion 443, and cover member 460 as such is prevented from falling face-up. In other words, cover member 460 is prevented from falling so that the back surface thereof is facing upward. Specifically, as shown in FIGS. 21 and 22, proximal-end upper surface portion 465 of cover member 460 is in contact with part of the proximal end portion (that is, the portions on both sides that are contiguous with ejecting tab 480) of cover member 460 at both ends 443*a* and 443*b* of the horseshoe-shaped portion. The portion protrudes to the rear in the center portion of stopper portion 443 outside the region in which ejecting tab 480 rotates.

Electronic-component connector 400 can thus be prevented from touching another electronic component on the mounting substrate as a result of cover member 460 falling face-up.

Ejecting tab 480 is integrally formed with cover member 460, so that it is possible to reduce the cost of manufacturing electronic-component connector 400 that is easily attached to and detached from module 250 even when the size of module 250 is reduced.

The present invention is not limited to the configuration in which the ejecting tab provided to electronic-component connector 400 is integrally formed with cover member 460.

Ejecting tab 480 may be formed in any manner providing that module 250 fitted into open portion 410 by insertion from above is ejected by ejecting tab 480 in the opposite direction from the insertion direction in conjunction with the rotation of cover member 460 in the opening direction in electronic-component connector 400.

For example, in a modified example of the ejecting tab, a single shaft is used instead of shaft portions 461 provided to the two side wall portions of the housing in the electronic-component connector described above, and the ejecting tab is rotatably attached so as to extend in the longitudinal direction in the portion of the shaft that is between the side walls. The ejecting tab attached to the shaft in this manner has a contacting portion that comes into contact with the retaining tab of module 250, and a pressure-receiving portion that is pressed by the edge of the proximal end of the proximal-end upper surface portion of the cover member that does not have an ejecting tab, and is on the opposite side from the contacting portion via the shaft. In other words, a configuration is adopted in which the pressure-receiving portion is pressed downward by the rotation of the cover member in the opening direction, and this pressure moves the contacting portion upward about the shaft and pushes the retaining tab upward.

In electronic-component connector 400 of Embodiment 2, a configuration was adopted in which presser plate 169 was formed in distal-end upper surface portion 464 in cover member 460, but this configuration is not limiting, and presser plate 169 need not be formed.

Thus, according to the configuration of Embodiment 2, when module 250 is connected in a state in which optical waveguide 200 extends from one side as a signal transfer member, module 250 is inserted into open portion 410, optical waveguide 200 is brought out to the outside of connector body 430 via lead-out path 430*c* as a lead-out portion, and module 250 is fixed in connector body 430. Therefore, electronic-component connector 400 can reliably fix module 250 in a state of electrical connection in the contact portion without touching optical waveguide 200 or retaining optical waveguide 200.

Ejecting tab 480 is also provided that protrudes into open portion 410 in conjunction with the rotation of cover member 460 in the opening direction away from open portion 410, and causes module 250 inserted into open portion 410 to eject to the open side of open portion 410. Module 250 inserted into open portion 410 of connector body 430 can therefore be ejected to the open side of open portion 410 by ejecting tab 480, and can be easily removed from the state of connection to the contact terminals in open portion 410 merely by rotating the lid in the opening direction.

Accordingly, even when the size of the assembly is reduced by reducing the size of the packaging space, module 250 can easily be attached and detached without modifying module 250 or electronic-component connector 400 so that the module or the connector are made attachable or detachable as such.

Cover member 460 is attached to connector body 430 so as to be able to rotate at one end thereof via the shaft portion, and ejecting tab 480 is provided to one end portion of cover member 460 so as to extend in a direction that intersects the extension direction of cover member 460 from the above-described end portion and to move about the shaft portion in conjunction with the rotation of cover member 460 in the opening direction, and so that the free end thereof protrudes into open portion 410 from below. Ejecting tab 480 is therefore integrally formed with cover member 460, and the cost of manufacturing electronic-component connector 400 that is easily attached to and detached from module 250 can be reduced even when the size of accommodated and connected module 250 is reduced.

Retaining tab 256 is also formed in module 250 in electronic-component connector 400 of the present invention. Therefore, when module 250 is inserted into open portion 410, and cover member 460 is rotated in the opening direction, ejecting tab 480 comes into contact with retaining tab 256 from below, and thereby module 250 is retained at ejecting tab 480. It is possible to prevent ejecting tab 480 from exerting stress on entire module 250 connected to electronic-component connector 400 during detachment.

In the present embodiment, a module connected to electronic-component connector 100 or 400 was described as an optical-waveguide module, but the present invention is not limited to this, and other possible examples include a module (electronic component) that does not have an optical waveguide but converts optical signals into electrical signals, a module (electronic component) for processing signals from a transmission medium for transmitting electric signals other than optical waveguides, such as electrical wires, cables, and flexible cables, for example, or any other module for processing signals via a transmission member for transmitting electrical signals.

According to the present invention configured as described above, it is possible to provide a secure detachable connection that is packaged in a small space even when the electronic component such as a module that is linked to a transfer member of a signal such as an optical waveguide, and that transmits and receives a signal such as an optical signal via the transfer member. Further, even when the size is reduced in accordance with reduced packaging space, it is possible to easily perform detachment.

What is claimed is:

1. An electronic-component connector that connects an electronic component connected in a state in which a signal transfer member extends from one side, the electronic-component connector comprising:

a connector body that comprises a contact terminal that is provided inside an open portion, said open portion opening upward and accommodating the electronic-component inserted from an open side of said open portion, and that is used for contacting a connection terminal of the electronic-component when the electronic-component is inserted into the open portion;

a lead-out portion that is formed continuously with the open portion in the connector body and is used for guiding the transfer member that extends from the electronic-component accommodated in the open portion to an outside of the connector body; and a fixing portion that is attached to the connector body for the open side such that the open portion is covered and is used for pushing the electronic-component inserted into the open portion in an insertion direction by a pushing portion which deforms elastically and detachably fixing the electronic-component to the connector body.

2. The electronic-component connector according to claim 1, wherein the transfer member is an optical waveguide.

3. The electronic-component connector according to claim 1, wherein:

the connector body comprises a pair of side wall portions that are disposed opposite each other over the open portion and the lead-out path, and are each provided with the contact terminal in a portion of an opposing face in the open portion;

in an upper portion of the connector body, a recessed portion is formed in a position that excludes an upper portion of a position in which the contact terminal is provided in the side wall portion; and an upper surface portion that forms an upper surface of the fixing portion is disposed in the recessed portion.

4. The electronic-component connector according to claim 3, wherein:

the upper surface portion comprises an installation plate portion that is installed on the open portion; and the pushing portion extends along the side wall portion on the open portion from the installation plate portion, and a free end comes into contact with an electronic-component inserted into the open portion and pushes the electronic-component in an insertion direction.

5. The electronic-component connector according to claim 4, wherein a free end of the pushing portion comes into contact with a substantially central portion of the electronic-component inserted into the open portion.

6. The electronic-component connector according to claim 4, wherein the pushing portion comprises a leaf spring member that extends at an angle downward from the installation plate portion.

7. The electronic-component connector according to claim 1, wherein the fixing portion is made from a resin.

8. The electronic-component connector according to claim 1, wherein:

the electronic-component is formed using a conducting member having electrical conductivity, and comprises an exterior portion that covers from above a body of the electronic-component in which the transfer member extends from one side;

the connector body is provided with a fixed terminal portion that is fixed in a state of electrical connection to a ground portion of a substrate on which the fixed terminal portion is mounted; and the fixing portion is formed using a conducting member having electrical conductivity, and, when the electronic-component is fixed, the fixing portion comes into contact with the exterior portion of the electronic-component, and is connected to the fixed terminal portion.

9. The electronic-component connector according to claim 8, wherein:

the connector body comprises a housing portion that comprises the open portion, the contact terminal and the lead-out path; and a shield portion that is formed using a conducting member having electrical conductivity, comprises the fixed terminal portion, is provided so as to surround the housing portion from a side, and is used for shielding the electronic-component accommodated in the open portion of the housing portion;

the pushing portion is disposed at an upper portion of the connector body, comes into contact with the exterior portion of the electronic-component inserted into the open portion, and pushes the electronic-component in an insertion direction; and the fixing portion is formed continuously with the pushing portion and is used for engaging with a locking portion of the shield portion and fixing the electronic-component in a state in which the electronic-component accommodated in the open portion is pushed by the pushing portion.

10. The electronic-component connector according to claim 3, wherein:

the fixing portion comprises an installation plate portion that is installed on the open portion of the connector body; and a pushing portion that is provided so as to extend from the installation plate portion, and a distal end portion which is a free end which comes into contact with the electronic-component and pushes the electronic-component in an installation direction.

11. The electronic-component connector according to claim 10, wherein the pushing portion comprises a leaf spring member that extends at an angle downward from the installation plate portion.

12. An electronic-component connector that is connected in a state in which a signal transfer member extends from one side, the electronic-component connector comprising:

a connector body that comprises a contact terminal that is provided inside an open portion, said open portion opening upward and accommodating the electronic-component inserted from an open side of said open portion, and that is used for contacting a connection terminal of the electronic-component when the electronic-component is inserted into the open portion;

a lead-out portion that is formed continuously with the open portion in the connector body and is used for guiding the transfer member that extends from the electronic-component accommodated in the open portion to an outside of the connector body;

a lid portion that is fitted to the connector body so as to be able to pivot open and closed and is used for covering the open portion from an open side, pushing the electronic-component inserted into the open portion in an insertion direction and fixing the electronic-component; and an ejecting portion that moves in conjunction with rotation of the lid portion in an opening direction away from the open portion and protrudes into the open portion, and is used for pushing the electronic-component inserted into the open portion out of the open portion and towards the opening.

13. The electronic-component connector according to claim 12, wherein:

the lid portion is attached to the connector body so as to be able to rotate at one end about shaft portion; and the ejecting portion is provided to one end of the lid portion so as to extend from the same end in a direction that intersects with an extension direction of the lid portion and to move about the axis portion in conjunction with rotation of the lid portion in an opening direction, and so that a free end protrudes into the open portion from below.

14. The electronic-component connector according to claim 13, wherein the electronic-component is provided with a retaining portion with which the pushing portion comes into contact from below when the electronic-component is inserted into the open portion, and the lid portion is rotated in an opening direction.

15. The electronic-component connector according to claim 12, comprising a stopper portion that restricts movement of the lid portion in an opening direction with respect to the connector body.

* * * * *